US009382721B2

(12) United States Patent
Morta et al.

(10) Patent No.: US 9,382,721 B2
(45) Date of Patent: Jul. 5, 2016

(54) MODULAR SECURITY SYSTEM FOR ABOVE-GROUND STRUCTURES

(71) Applicants: Steven P. Morta, Aberdeen, WA (US); Horst G. Hermsdorf, Ocean Shores, WA (US)

(72) Inventors: Steven P. Morta, Aberdeen, WA (US); Horst G. Hermsdorf, Ocean Shores, WA (US)

( * ) Notice: Subject to any disclaimer, the term of this patent is extended or adjusted under 35 U.S.C. 154(b) by 0 days.

(21) Appl. No.: 14/121,037

(22) Filed: Jul. 22, 2014

(65) Prior Publication Data

US 2015/0300035 A1 Oct. 22, 2015

Related U.S. Application Data

(60) Provisional application No. 61/958,513, filed on Jul. 29, 2013.

(51) Int. Cl.

| | |
|---|---|
| ***E04H 9/14*** | (2006.01) |
| ***E04H 15/24*** | (2006.01) |
| ***E04H 9/10*** | (2006.01) |
| ***E04H 9/02*** | (2006.01) |
| ***E04H 1/12*** | (2006.01) |
| ***E04H 15/00*** | (2006.01) |
| ***E04H 15/34*** | (2006.01) |
| ***E04H 15/60*** | (2006.01) |
| ***F41H 5/24*** | (2006.01) |
| *E04B 1/00* | (2006.01) |

(52) U.S. Cl.

CPC ..... *E04H 9/10* (2013.01); *E04H 1/1205* (2013.01); *E04H 9/028* (2013.01); *E04H 9/14* (2013.01); *E04H 15/008* (2013.01); *E04H 15/34* (2013.01); *E04H 15/60* (2013.01); *F41H 5/24* (2013.01); *E04B 2001/0069* (2013.01); *E04H 15/24* (2013.01)

(58) Field of Classification Search

None

See application file for complete search history.

(56) References Cited

U.S. PATENT DOCUMENTS

| | | | | | |
|---|---|---|---|---|---|
| 490,779 | A | | 1/1893 | Zimmerman | |
| 1,672,306 | A | * | 6/1928 | Coupal | E04H 15/00 135/100 |
| 2,282,433 | A | * | 5/1942 | Soderquist | E04H 15/00 135/114 |
| 2,876,872 | A | * | 3/1959 | Roberts | E04H 15/24 135/100 |
| 4,258,514 | A | * | 3/1981 | St. Clair | E04B 1/343 135/116 |
| 4,265,261 | A | * | 5/1981 | Barker | E04H 15/24 135/100 |
| 4,838,292 | A | * | 6/1989 | Allen | E04B 1/3211 135/100 |
| 4,838,293 | A | * | 6/1989 | Novak | E04H 15/24 135/100 |
| 5,297,012 | A | * | 3/1994 | Fletcher | B60Q 7/00 362/235 |

(Continued)

*Primary Examiner* — Brian Mattei
*Assistant Examiner* — Kyle Walraed-Sullivan
(74) *Attorney, Agent, or Firm* — Brian J. Coyne

(57) ABSTRACT

A system of modular components for on-site assembly of a shelter for an above-ground structure to protect the structure from blast, wind, fire or other physical hazards. A pyramidal shelter with triangular or rectangular base is formed by joining side panels to each other. Each side panel includes a triangular frame covered, except at access hatch, observation port and door openings, with either steel plate or diamond steel mesh to which blast-resistant, fire-resistant or other kinds of coatings or panels are applied. A corner anchor assembly to support each corner of a shelter has a lower plate, an overlying split plate, and a pair of upstanding, anchor rods attached to the split plates for insertion into hollow, lower portions of side beams of adjacent side panels. The corner anchor assemblies facilitate expansion of an assembled shelter by addition of more modular components.

9 Claims, 24 Drawing Sheets

(56) References Cited

U.S. PATENT DOCUMENTS 5,400,541 A 3/1995 Ennamorato et al.
5,867,947 A 2/1999 Holtz Hale
5,930,961 A * 8/1999 Beaudet ..... E04H 9/12 52/169.6
6,131,343 A * 10/2000 Jackson, Jr. ..... E04H 9/14 52/169.6
6,151,841 A * 11/2000 Green ..... E04H 9/14 109/1 S
6,412,231 B1 * 7/2002 Palatin ..... E04H 9/10 109/1 S
6,656,238 B1 12/2003 Rogers et al.
6,656,239 B1 12/2003 Rogers et al.
6,689,470 B1 2/2004 Joseph
6,814,765 B1 11/2004 Rogers
6,833,012 B2 12/2004 Rogers
6,861,151 B1 3/2005 Rogers et al.
7,497,048 B2 * 3/2009 Bakowski ..... A01G 13/043 135/100
7,600,348 B1 * 10/2009 Kostka ..... E04H 9/10 135/97
7,736,729 B2 6/2010 Chang et al.
8,071,206 B1 * 12/2011 Chang ..... C08J 5/10 428/304.4
2002/0046515 A1 * 4/2002 McCarthy ..... E04H 9/14 52/169.6
2004/0177568 A1 * 9/2004 Hanks ..... E04H 9/14 52/79.1
2007/0000183 A1 * 1/2007 Logan ..... E02D 5/803 52/3
2007/0039639 A1 * 2/2007 Duncan ..... E04H 9/10 135/97
2010/0107545 A1 * 5/2010 Montague ..... E04B 1/24 52/699
2010/0107938 A1 * 5/2010 Heselden ..... E04H 9/10 109/1 S
2011/0197746 A1 * 8/2011 Melrose ..... F41H 5/013 89/36.02
2015/0159393 A1 * 6/2015 Gulik ..... E04H 9/10 109/1 S

* cited by examiner

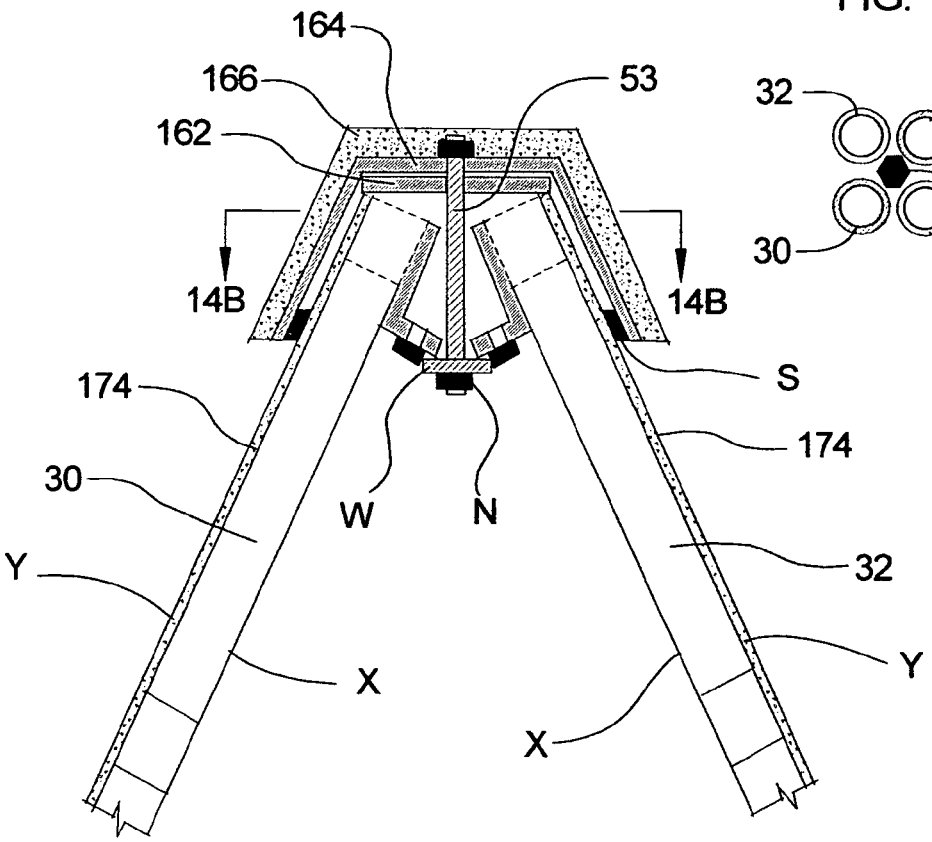
FIG. 14A
FIG. 14B
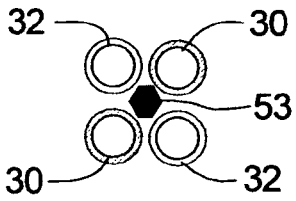

MODULAR SECURITY SYSTEM FOR ABOVE-GROUND STRUCTURES

CROSS-REFERENCE TO RELATED PATENT APPLICATIONS

This application claims the benefit of provisional application No. 61/958,513 by the same applicants for the same invention, filed Jul. 29, 2013, the disclosure of which is incorporated herein.

STATEMENT REGARDING FEDERALLY APPROVED RESEARCH OR DEVELOPMENT

None.

BACKGROUND OF THE INVENTION

1. Field of the Invention

The present invention relates generally to hardened shelters that protect above-ground structures from blast, storm, wind, fire, earthquake and other physical hazards. More particularly, the invention relates to such shelters that can be erected on-site by assembly of factory prefabricated, modular components. In some versions, camouflage and concealment of entryways into the shelters is provided to prevent unauthorized access or tampering with the above-ground structures within the shelters.

2. Background Art

Examples of above-ground structures that may be sheltered from blast, storm, wind, fire, earthquake and other natural hazards, as well as from attacks by military or terrorist organizations, include the following: oil pipeline valves; high voltage transformers; storage lockers containing personal items, first aid, medical and emergency food supplies; weapons caches; and battle field command and border security monitoring stations. To adequately protect such above-ground structures, such a shelter needs to be strong, capable of surviving blasts, even bomb blasts, fire-resistant if fire is a recognized hazard at the shelter's location, capable of such strong attachment to a ground surface as not to be dislodged even when subjected to very high wind force, cyclone or tornado, and secured against tampering and/or unauthorized entry by suitable locks, entryways and/or camouflage. Such a shelter should be easily erectable on site by assembling factory-prefabricated, modular components that require a minimum amount of materials to achieve the required strength, blast-resistance and other goals listed above. In the event an above-ground structure is expanded over a larger area of ground surface, the surrounding shelter should be easily expandable to accommodate the new, larger, above-ground structure by adding additional, modular components to the shelter.

The present invention assembles a shelter from modular, factory-prefabricated panels to minimize the amount of required materials while at the same time achieving the required strength and other goals, using equilateral triangular panels with attached frame members to form the sides of the shelter. To firmly attach the shelter to a ground surface, the present invention provides anchor assemblies to which lower ends of frame members attach. On-site installation of the shelter includes driving rebar through apertures in the anchor assemblies deep enough below ground to prevent dislodgement by blast or high velocity winds. The anchor assemblies that attach to the frame members include telescopic sections to facilitate installation of the shelter on sloped or uneven ground.

Various attempts have been made prior to the present invention to provide a shelter for above-ground structures and thereby achieve at least some of the above-listed goals. U.S. Pat. No. 490,779 to Zimmerman disclosed a shelter in the form of a rectangular pyramid for protection of a dwelling, barn or other above-ground structure against cyclones, wind, rain, and snow storms. Apertured, anchor irons attached to the four corners of the building were secured underground with stakes.

U.S. Pat. No. 6,151,841 to Green disclosed a prefabricated, portable, tornado shelter assembled from four equilateral triangular sides, a base frame, and a floor, to form a square, pyramid-shaped enclosure with latched doors and Plexiglas® windows. The shelter was held to the ground with four auger bolts.

U.S. Pat. No. 5,867,947 to Holt Hale et al. disclosed a folding pyramidal structure to surround and protect one or several people and bear extreme loads imposed by the collapsing of a building, induced, for example, by seismic waves during an earthquake.

U.S. Pat. No. 1,672,306 to Coupal disclosed a pyramidal tent with a square floor and tetrapod frame. The frame included four corner staffs or legs comprising telescopic sections disposed at the corner angles of the walls of the tent.

U.S. Pat. No. 5,400,541 to Ennamorato et al. disclosed a tepee tent for a tripod tree stand comprising a pyramidal tent having a triangular floor providing shelter for hunters and the like, and an upper platform that was supported by the tent and accessible by an external ladder. The tent could be secured to a ground surface by driving stakes into the ground through apertures in retention tabs at the three, lower corners of the tent.

Although none of the foregoing disclosures provided a shelter that could be assembled from modular components, U.S. Pat. No. 8,397,738 B2 to Livacich et al. disclosed a modular system for concealment and shelter. The system permitted configuring a number of concealment blinds or shelters using brackets, supports, segmented shafts, covers, curtains, skirts and more complex modules. Modules could include cover caps, including domes, cylindrical arches and pyramids.

Nevertheless, prior to the present invention, no system comprising factory prefabricated, modular components was known that could be easily assembled on-site to provide a shelter for an above-ground structure against blast, storm, wind, fire, earthquake and other natural hazards, as well as from attacks by military or terrorist organizations, and, in addition, could be readily expanded by adding thereto additional modular components in the event the shelter needed to be enlarged to accommodate an increase in size or number of above-ground structures.

SUMMARY OF INVENTION

Thus, there remains a need for a modular security system that provides factory-prefabricated, modular components readily assemblable on-site to form a shelter for an above-ground structure and thereby protect the structure from blast, storm, wind, fire, earthquake and other physical hazards, and which shelter, after initial on-site installation, can readily be enlarged by adding thereto additional modular components. The present invention meets this need by providing a modular system of factory-prefabricated, modular components that can be assembled on-site and firmly secured to a ground surface to form, for example, any of the following kinds of shelters: a pyramidal shelter with a triangular base and three side panels; a pyramidal shelter with a rectangular base and four side panels; an expanded shelter with a double square base comprising a first and a second incomplete square pyramidal shelter joined one to another in tandem along a line of common joinder, the first incomplete, square pyramidal shelter comprising first, second and third side panels, and the second, incomplete square pyramid shelter comprising fifth, sixth and seventh side panels, with inverted fourth and eighth side panels being attached at triangular gaps between the first and second incomplete, square pyramidal shelters during on-site assembly to complete the double square pyramid shelter.

Each side panel comprises a triangular frame comprising two side beams with upper ends converged at an apex and with opposite, lower ends joined by a laterally-disposed base beam. A side panel frame may further include a parallel pair of jambs, a lateral header, a lateral sill, and reinforcement struts that define either an access hatch opening or a doorway opening. Except for such openings, covering means covers at least one side of each side panel frame—that is, covers either an interior side, an exterior side, or both sides of a side panel. The covering means may comprise flat steel plate or a diamond steel mesh to which various kinds coatings are applied to achieve resistance to high winds, blast, bullets or other penetrating objects, or fire.

The system includes two kinds of anchor assemblies: corner anchor assemblies and mid-base beam anchor assemblies. Each corner anchor assembly includes a horizontal, upper, split plate that overlies, and rests upon, a horizontal, lower plate. The upper, split plate comprises first and second upper plates in side by side, coplanar relation that reversibly attach to the lower plate by fasteners. The upper and lower plates have apertures that permit driving rebar down through the apertures deep enough into the ground to secure the assemblies from dislodgement in the event of blast, strong wind, earthquake, etc. In a preferred embodiment, each of the side beams has a hollow, lower end portion and each of the first and second upper plates includes an upstanding anchor rod. Each anchor rod has a lower end attached to an upper plate at a 60 degree angle with respect to that plate and an opposite, upper end, which upper end is shaped and dimensioned for close-fitting, telescopic insertion into the hollow, lower end portion of a first or second side beam of a side panel. Means is provided for reversibly locking the anchor rod within a lower end portion of a side beam of a side panel—e.g., by inserting a locking pin horizontally through aligned apertures in the anchor rod and said lower end portion.

At each lower corner of a triangular or square pyramid shelter, adjacent, joined side panels share, and are supported by, a single corner anchor assembly. This is accomplished during on-site assembly by inserting the anchor rod of the first upper plate into a hollow end of a side beam of a first side panel and by inserting the anchor rod of the adjacent, second upper plate into an adjacent side beam of a second, adjacent side panel. When the base beams of the two panels are level, the anchor rods are locked in position within the side beams of those panels with the locking means. Apertured steel strapping is attached to and extends along substantially the entire length of each side beam of each side panel. The same side beams are themselves then joined to each other by aligning adjacent edges of the panels with their steel strapping overlapping and with their apertures aligned in registry, joining the steel strappings of the adjacent panels together with fasteners (e.g., bolts) inserted through the aligned apertures.

The ability to disattach the first and second upper plates from a corner anchor assembly, as well as to disengage adjacent, joined steel strapping, facilitates expanding a shelter to cover a larger area of ground by joining additional side panels to an installed shelter. In particular, a square pyramid shelter can be expanded to a double square pyramid shelter by removing one side panel therefrom at a line of common joinder at the base of the shelter, thereby forming a first, incomplete square pyramid shelter, assembling at the line of common joinder a mirror-image, second, incomplete square pyramid, and then completing the double square pyramid shelter by attaching to them a pair of inverted side panels at the triangular gaps between the first and second incomplete square pyramid shelters, the two inverted side panels, once joined, being disposed perpendicular to the line of common joinder. In this process, the original four corner anchor assemblies of the square pyramid shelter are retained, but each of the two original corner anchor assemblies that lie on the line of common joinder is now also attached to and supports one of the newly added side panels—an assembly process that is facilitated by the split upper plates of the corner anchor assemblies.

Each mid-base beam anchor assembly comprises a single plate and an upstanding anchor rod attached at a 60-degree angle with respect to an upper surface of said plate—e.g., by a weld. A side panel that includes a parallel pair of jambs is preferably supported by a mid-base anchor assembly installed under, and attached to, a hollow lower end of each jamb. During on-site assembly of a shelter that includes such a side panel, the upstanding anchor rods of the mid-base beam anchor assemblies telescopically insert into the hollow, lower end portions of the jambs and, after adjustment to allow for uneven or sloped ground surface, are fixed in position with locking means, whereby a mid-portion of the side panel is supported by the mid-base anchor assemblies.

Means are provided for temporarily attaching eyebolts to the side panels to facilitate lifting the panels into desired positions during on-site construction, preparatory to attaching them to each other and to the corner and mid-base beam anchor assemblies. Ridge caps and corner ridge caps are provided to cover upper portions of each shelter. To guard against unauthorized access from underneath, a shelter may also include a floor. A variety of infills and coatings may be applied to the side panels to provide resistance to blast, gun fire, fire, and other physical hazards.

The present invention therefore provides the following advantages:

- No poured concrete is required for a foundation.
- The modular panels are generally uniform in shape and, therefore, relatively easy to prefabricate in a factory.
- The anchor assemblies are also prefabricated and preassembled at the factory, saving assembly time on-site.
- The system provides blast-proof doors and windows, if needed for a particular security application.
- When completed on-site, the shelter can be camouflaged to blend with other indigenous structures so that it does not stand out.
- The exterior of the structure can be made to look like an ordinary building, but be hardened on its inside to resist blast, penetrating objects, fire, etc.
- The anchor assemblies and modularity of the tetrahedral shape of the shelters make expansion of an installed shelter relatively easy to accomplish, and easy as well for disassembly and removal to a different location.

BRIEF DESCRIPTION OF THE DRAWINGS

FIG. 4A' is a cross-sectional view taken along line 4A'-4A' of FIG. 4A of a blast-resistant, glass observation port mounted to said frame between the access hatch opening and the apex of the front panel thereof;

FIG. 7B is an enlarged, fragmentary, cross-sectional view taken along line 7B-7B of FIG. 7A through the junction of adjacent side panels joined together at a 90-degree angle by a plurality of fasteners inserted through aligned apertures of steel strapping that are attached to the side beams of those panels, for the case when said adjacent side panels have been assembled into, and form a corner portion of, a second embodiment, square pyramid shelter;

FIG. 7C is an enlarged, fragmentary, cross-sectional view taken along line 7C-7C of FIG. 2, again showing the junction of adjacent side panels, but for the case when said side panels have been joined together at a 180-degree angle and assembled into, and form a part of, a third embodiment, double square pyramid shelter;

FIG. 9C is a vertical cross-sectional view taken along line 9C-9C of FIG. 9B.

FIG. 10B is a vertical cross-sectional view of the base of said panel taken along line 10B-10B of FIG. 10A;

FIG. 10C is a top plan view of said panel with an attached door shown swung partially open.

FIG. 10D is a vertical cross-sectional view of the base of said panel taken along line 10D-10D of FIG. 10E and FIG. 10E is a top plan view of said panel with said door shown closed and showing infill attached to an exterior surface of said panel.

FIG. 13B is a further enlarged, vertical, cross-sectional view thereof taken along line 13B-13B of FIG. 13A.

FIG. 13C is a fragmentary, top plan view of the apex of the frame only of a four-panel, square pyramid shelter with a rectangular base such as is depicted in FIG. 6.

FIG. 13D is an enlarged, front elevational view of an eyebolt temporarily attached to a top, apex end of a side panel to facilitate lifting and attachment of said panel during on-site assembly of a pyramid shelter (the eyebolt is removed upon completion of assembly of the shelter).

FIG. 13E is a top, plan view of an outward, 45-degree, apex-ridge end cap.

FIG. 13F is a top, plan view of a 90-degree, apex-ridge end cap.

FIG. 13G is a fragmentary, cross-sectional view of a left panel and a right panel of the frame of a three- or four-panel, pyramidal shelter, joined at an apex-ridge, apex portion, covered by an overlying apex-ridge plate.

FIG. 13H is a side elevational view of the outward, 45-degree, apex-ridge corner of FIG. 13E attached to the apex ridge of a double square, pyramidal shelter.

FIG. 13I is a top, plan view of the apex of the frame of two side panels joined at an apex-ridge and of the bolt that secures them to the apex-ridge.

FIG. 14A is an enlargement of FIG. 13B; and

FIG. 14B is a top, plan view thereof along line 14B-14B of FIG. 14A showing the top, apical ends of the tubular frame and of the bolt that secures them.

Figure 3A:
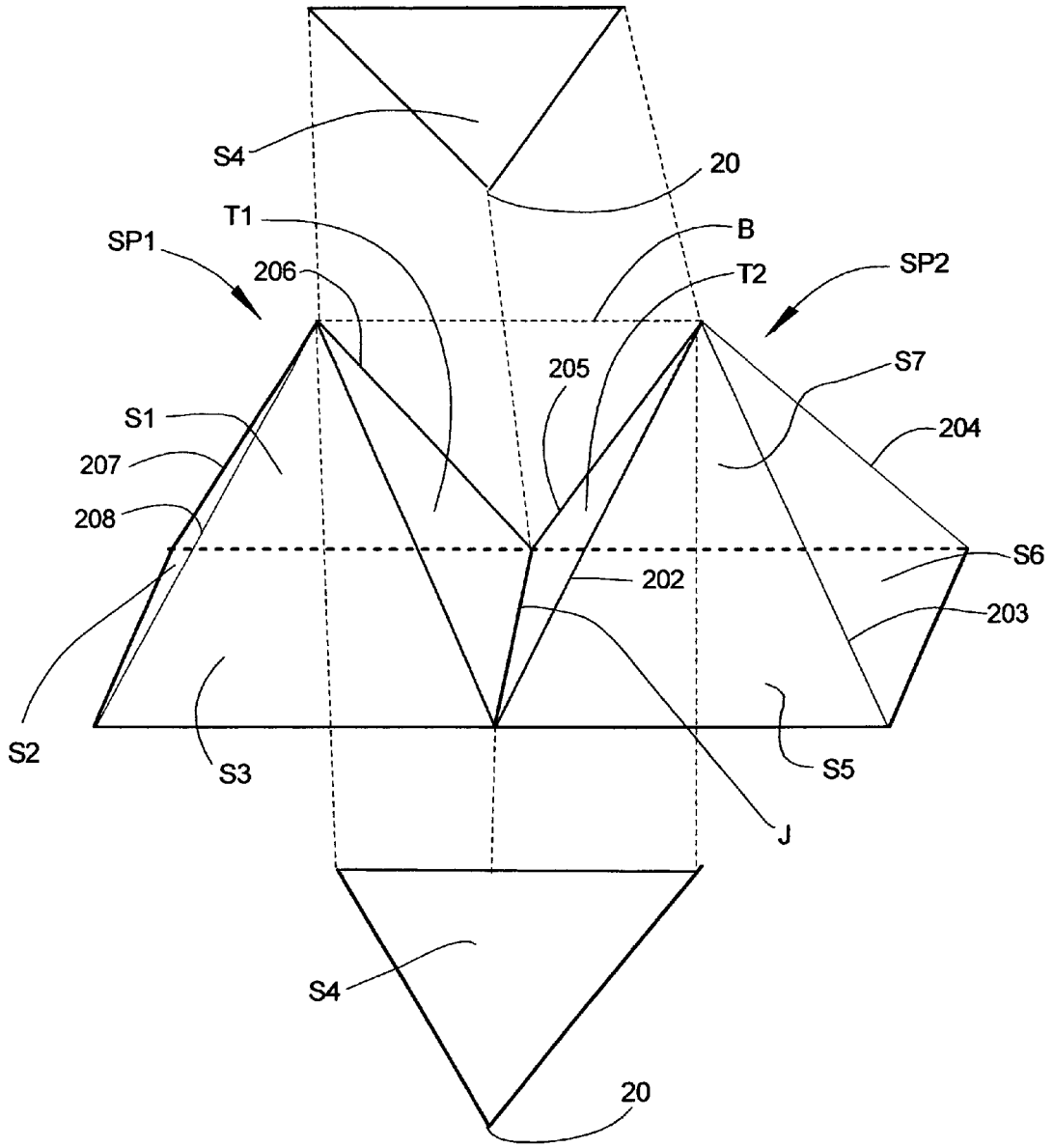
FIG. 3A is a schematic diagram illustrating the manner in which eight side panels of the invention can be assembled to form a double square pyramid shelter.
Figure 3B:
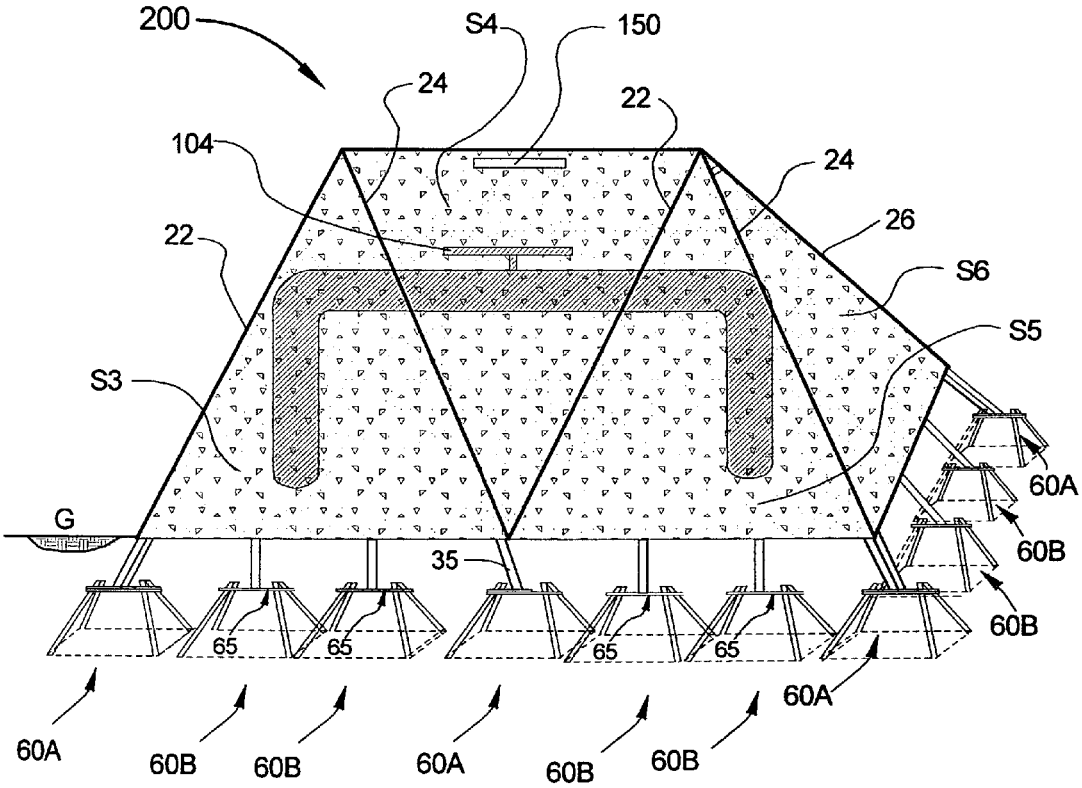
FIG. 3B is a front, elevational view of the third embodiment, double square pyramid shelter of the invention enclosing an above-ground, oil pipeline valve.
Figure 4A:
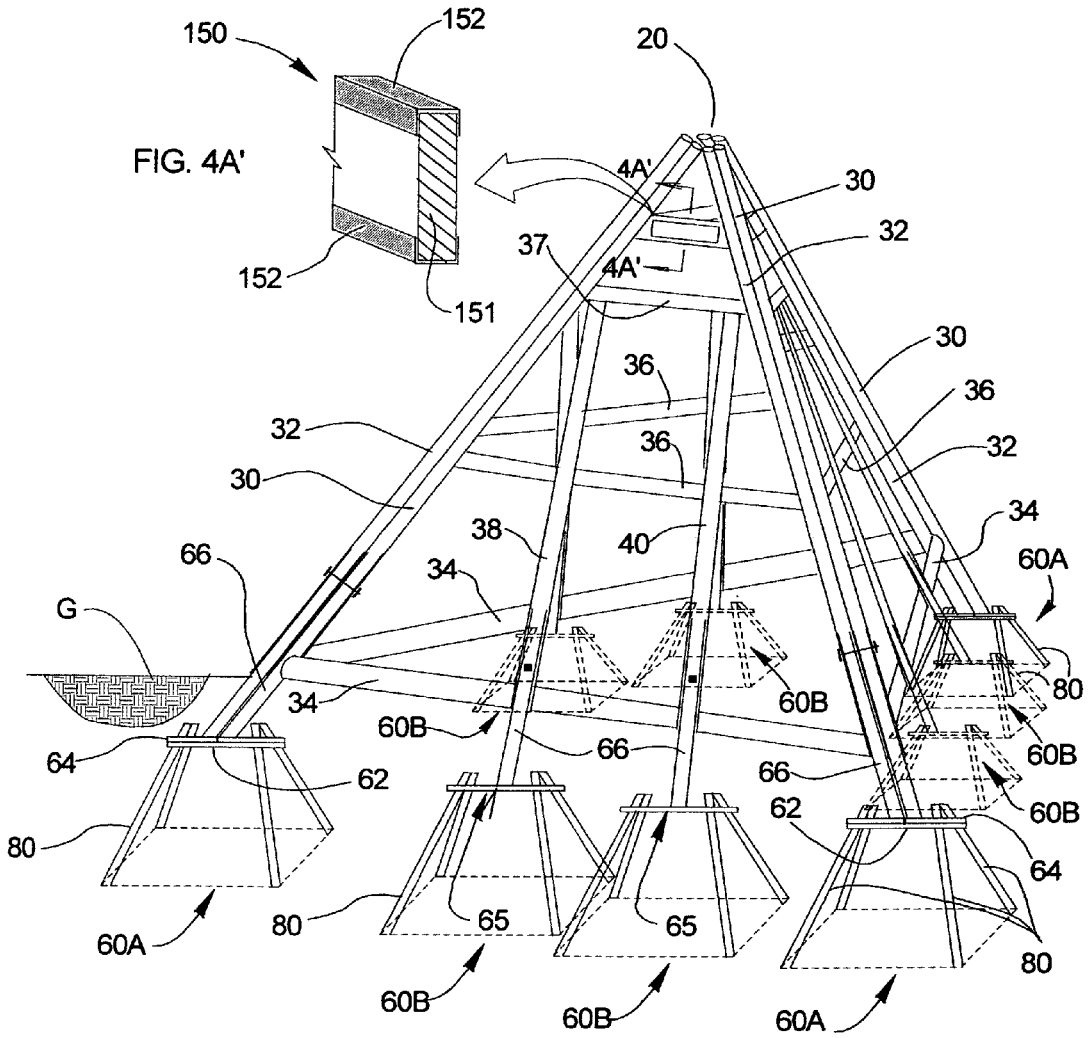
FIG. 4A is a front, perspective view of the first embodiment as depicted in FIG. 1A, but with the infills and coatings thereof removed to reveal the frames of the side panels.
Figure 4B:
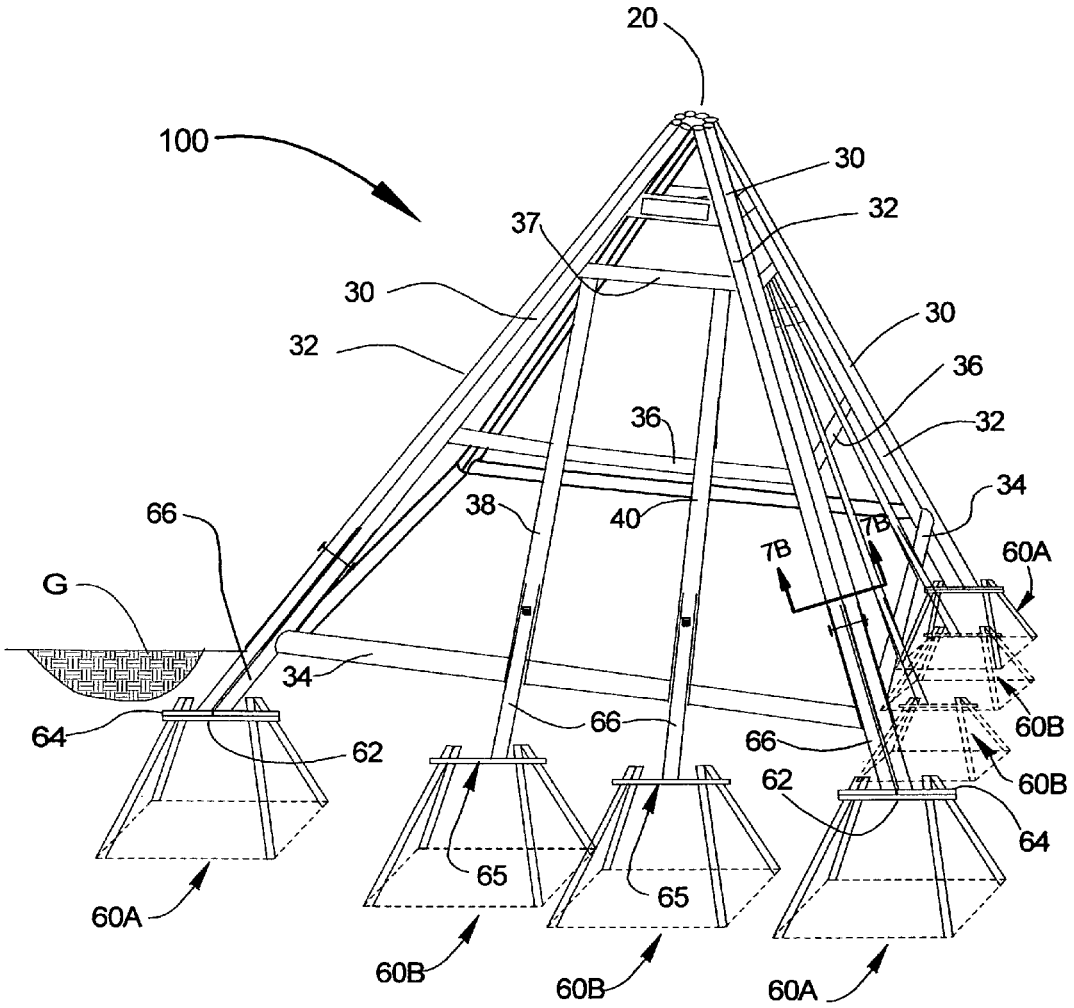
FIG. 4B a front, perspective view of the second embodiment as depicted in FIG. 1B, with the infills and coatings thereof removed to reveal the frames of the side panels.
Figure 4C:
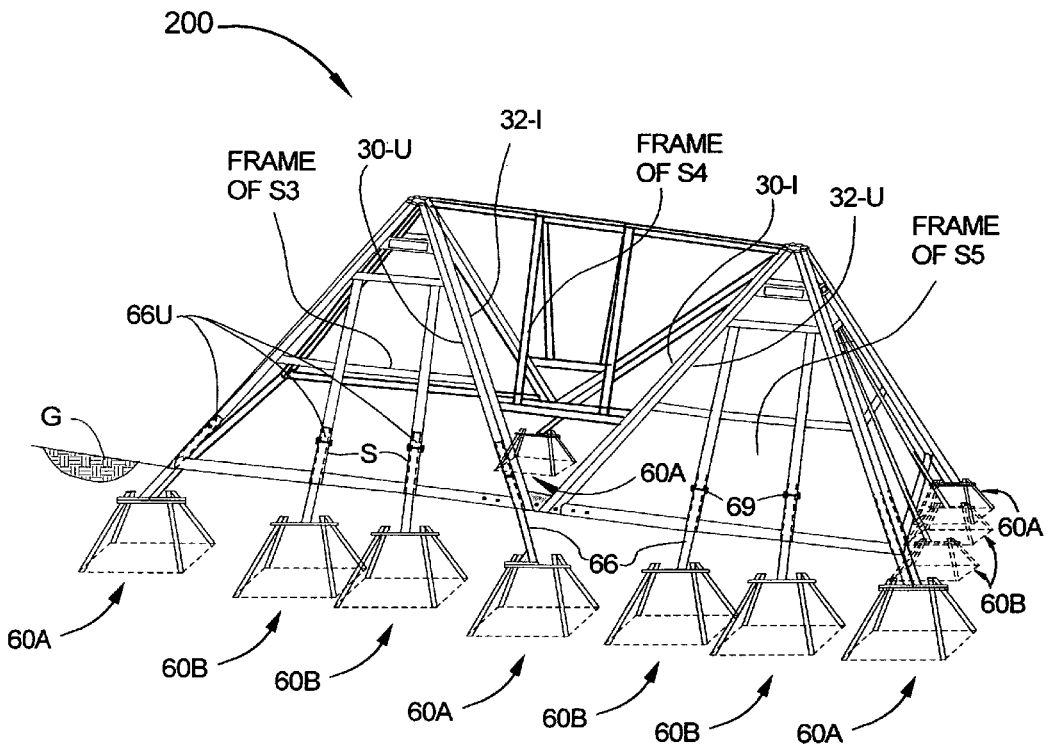
FIG. 4C is a front, perspective view of the third embodiment as depicted in FIGS. 2 and 3B, with the infills and coatings thereof removed to reveal the frames of the side panels.

Like numerals denote like parts throughout the several views except that, once any of the side panels—for example, the rear 12', right side 14', front 16' and left side 17' panels of a square pyramid shelter—have been incorporated into a double square pyramid shelter, those side panels are thereafter denoted as side panels S1, S4, S3 and S2, respectively, in order to be consistent with the reference characters for the side panels of a double square pyramid shelter as depicted, for example, in FIGS. 3A, 3B, and 4C.

DETAILED DESCRIPTION

Figure 1A:
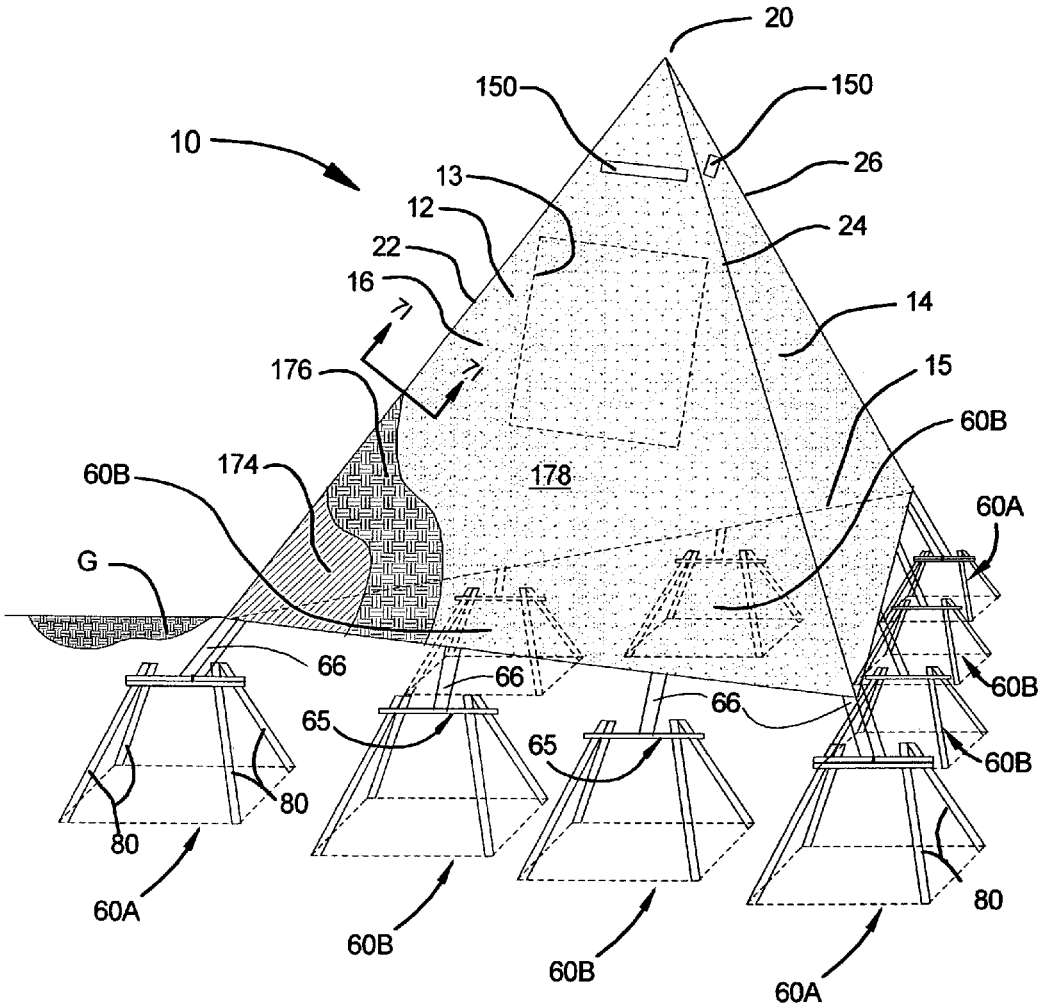
FIG. 1A is a front, perspective view of a first embodiment of a shelter of the present invention assembled in the shape of a pyramid having a triangular base and an access hatch, and made resistant to blast.
Figure 1B:
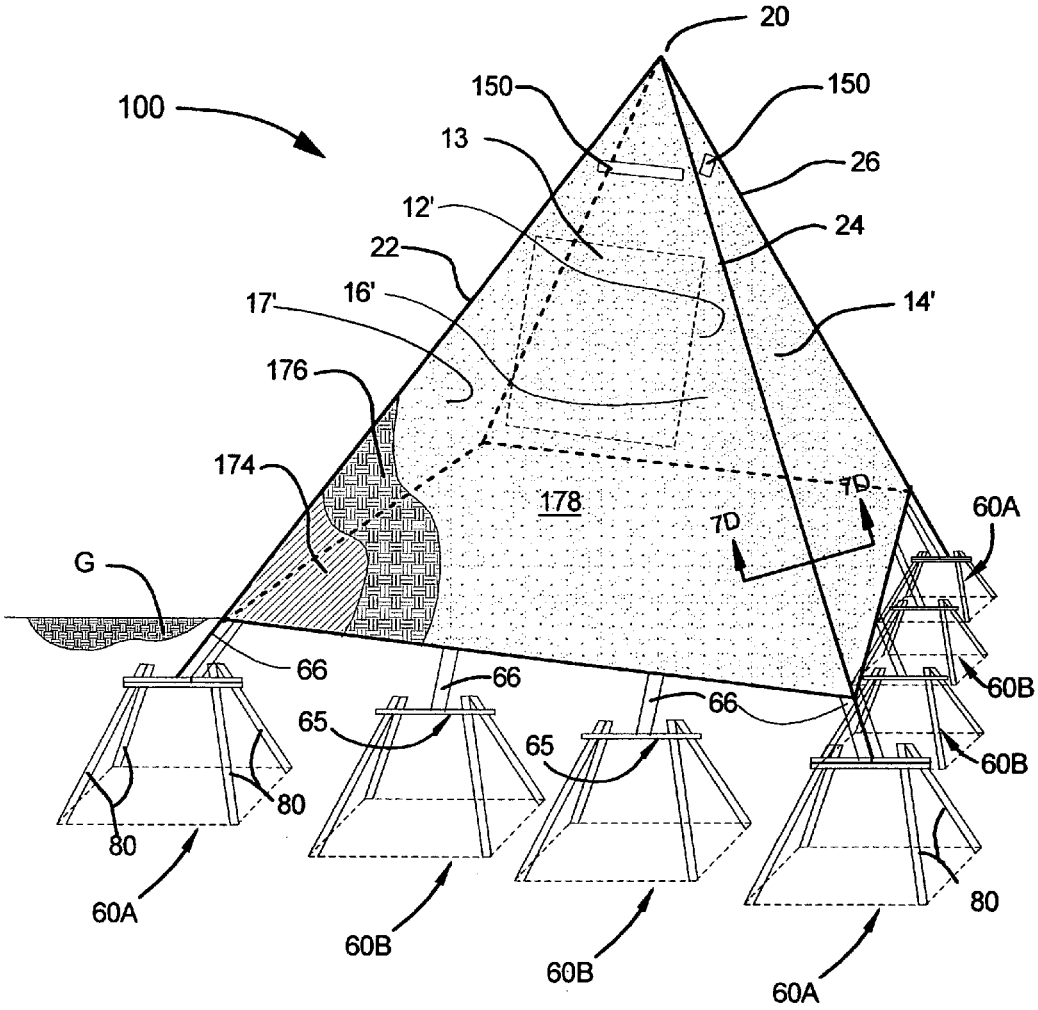
FIG. 1B is front, perspective view of a second embodiment of the present invention assembled in the shape of a pyramid having a square base and an access hatch, also made resistant to blast.
Figure 2:
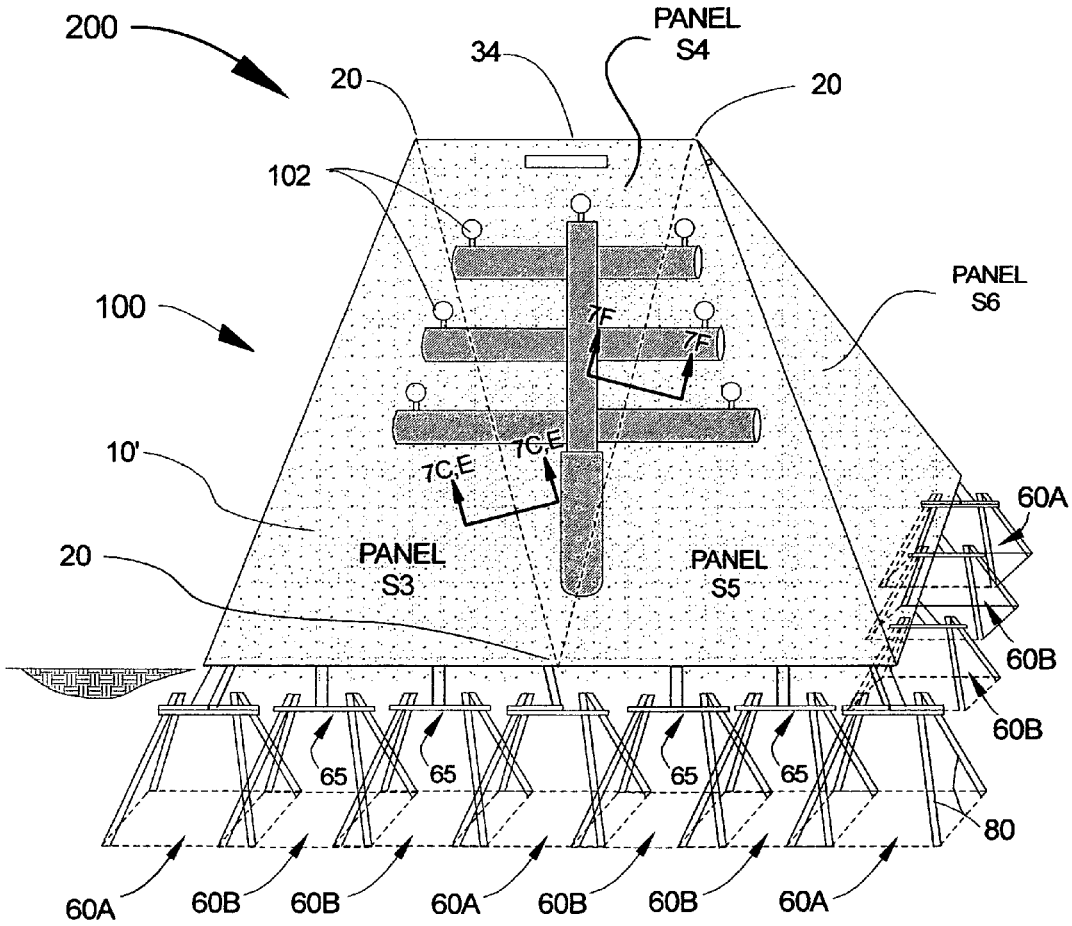
FIG. 2 is a front, perspective view of a third embodiment of the present invention in the form of an assembled, double square pyramid depicted as enclosing above-ground, oil pipeline pressure gauges.

The present invention comprises a system of factory prefabricated, modular components that can be assembled on-site to form a hardened shelter that is capable of protecting an above-ground structure and/or people from harm or damage due to blast, gun shot, storm, wind, fire, earthquake, and other physical hazards. Some of the larger of the modular components are the side panels, each of which has the shape of an equilateral triangle in plan view, and the floor panels, which may have the size and triangular shape of a side panel or may be rectangular in plan view. Thus, in its simplest form, a shelter may be assembled in the form of a pyramid with an equilateral triangular base (triangular pyramid shelter 10; FIG. 1A), or in the form of a pyramid with a square base (square pyramid shelter 100; FIG. 1B), or in the form of a pyramid with a double square base (double square pyramid 200; FIG. 2) wherein, in each case, inclusion of a triangular or square or double square floor panel into the shelter is optional and will ordinarily depend upon the particular circumstances of the site where the above-ground structure to be protected is located.

A preferred height for each equilateral triangular side panel, measured from the base of the triangle to the apex opposite said base, is eight feet, with the corresponding leg lengths (i.e., the base and two sides of the triangle) each being 9.24 feet. Optionally, however, side panels having greater or lesser heights with correspondingly greater or lesser leg lengths may be used for on-site assembly of a shelter, depending upon the intended uses of the shelter. Furthermore, the overall size and shape of the shelter itself can be changed and enlarged beyond the size and shape of a single assembled triangular 10, square 100 or double square 200 pyramid shelter by adding, on-site, additional triangular side panels to the shelter, as explained below.

FIG. 1A depicts an assembled shelter according to a first embodiment of the invention with a triangular base (triangular pyramid), which shelter is denoted generally by the numeral 10. The shelter 10 comprises a front side panel 12 having a rectangular access hatch opening 13 depicted in phantom outline, a right side panel 14, and a rear side panel 16, which, thus assembled, cooperate to form a triangular pyramid shelter with its base at ground surface G. A lower edge margin of the rear side panel 14 is denoted by an oblique, dashed line 15. The three side panels 12, 14, 16 extend obliquely upward from the triangular base and are joined along the triangular pyramid edges, and at their upper ends converge at a common apex 20 of the triangular pyramid shelter 10; that is, the front panel 12 is joined to the rear panel 16 along edge 22; the front panel 12 is joined to the right side panel 14 along edge 24; and the right side panel 14 is joined to the rear side panel along edge 26.

As may be seen in FIG. 4A, each of the front panel 12, the right side panel 14, and the rear side panel 16 of the triangular pyramid shelter 10 includes a triangular frame, and those frames are joined one to another along the triangular pyramid edges 22, 24, and 26 in the assembled shelter 10. In the illustrated embodiment shown in FIG. 1A, each of the panels 12, 14 and 16 includes a first side beam 30 and a second side beam 32 with upper ends that converge and are joined at the apex 20, and opposite, lower ends joined by a laterally-disposed, base beam 34, such that all three beams 30, 32, 34 cooperate to define an equilateral triangle. As shown in FIG. 10B, the base beam 34 preferably comprises square tubing 34S along the outside reinforced along the inside by steel angle 34A. Intermediate the base beam 34 and the apex 20 thereof, each of the frames of each of the side panels 12, 14, and 16 preferably further includes a first, laterally disposed, reinforcement strut 36 (FIG. 4A) that extends from the first side beam 30 to the second side beam 32 and has its opposite ends joined to said beams. In the triangular pyramid shelter 10 depicted in FIGS. 1A and 4A, the front panel 12 has a rectangular access hatch opening 13, that is defined at its upper end by a lateral header 37 and at its lower end by reinforcement strut 36 that acts as a lateral sill 36, and by parallel, left and right, longitudinally-directed, jambs 38, 40 that extend from the header down to the base beam 34. Each of the jambs 38, 40 has a hollow lower end joined to the base beam 34 and an opposite, upper end joined to one of opposite ends of the header 37 of said side panel frame.

Referring to FIGS. 10A-10E, it is seen that, instead of an access hatch opening 13, a side panel may include a doorway opening 50, using, however, the same header 37 and jambs 38, 40 that can be used to frame a hatch opening 13 in a side panel, but the lateral sill 36 is omitted. Thus, the frame of such a side panel may comprise, in addition to the first side beam 30, a second side beam 32, and a base beam 34, a header 37 that extends between, and has opposite ends that join, the first and second side beams 30, 32, thereby defining an upper margin of the doorway opening; parallel, left and right, longitudinal door jambs 38, 40 that extend between, and have opposite ends that join, the header 37 and the base beam 34 (i.e., the same as the access hatch jambs 38, 40); a second lateral strut 56 that extends between, and has opposite ends that join, the first side beam 30 and the left jamb 38; and a third lateral strut 58 that extends between, and has opposite ends that join, the second side beam 32 and the right jamb 40.

As shown in FIG. 7B, the first beam 30 and the second beam 32 of each side panel are preferably hollow, cylindrical steel pipes (e.g., 2-inch diameter, schedule 80 steel pipe) and the various reinforcement struts 36, 42, 44, 46, 48, 56, 58, and access hatch and door jambs 38, 40, as well as the base beam 34, are preferably hollow, square, steel tubing. Steel strapping 90 (e.g., 3-inch by 0.25-inch) with apertures 90A drilled at 9-inch intervals are attached (e.g., by weld) to an outer surface of each beam 30, 32 of each side panel (FIGS. 7B through 7H) and permit joining said beams together on the interior of a shelter along the edges 22, 24, 26 with high-temperature festeners (e.g., bolts) 63, on-site.

The modular system provides a plurality of anchor assemblies 60A, 60B for securing the shelter 10 to an on-site ground surface. In the first illustrated embodiment 10 depicted in FIG. 1A, there are preferably nine anchor assemblies as follows: one each of a corner anchor assembly 60A disposed below each of the three vertices of the triangular base of the shelter 10, and two, laterally spaced-apart, mid-base anchor assemblies 60B disposed below a central portion of the base beam 34 of each the three side panels. Extending downward one or two feet, more or less, through the apertures 80A are rebar sleeves RS (FIGS. 9A, 9B) to guide the insertion of rebar through those apertures at outward angles of about 45 degrees from vertical.

Figure 7A:
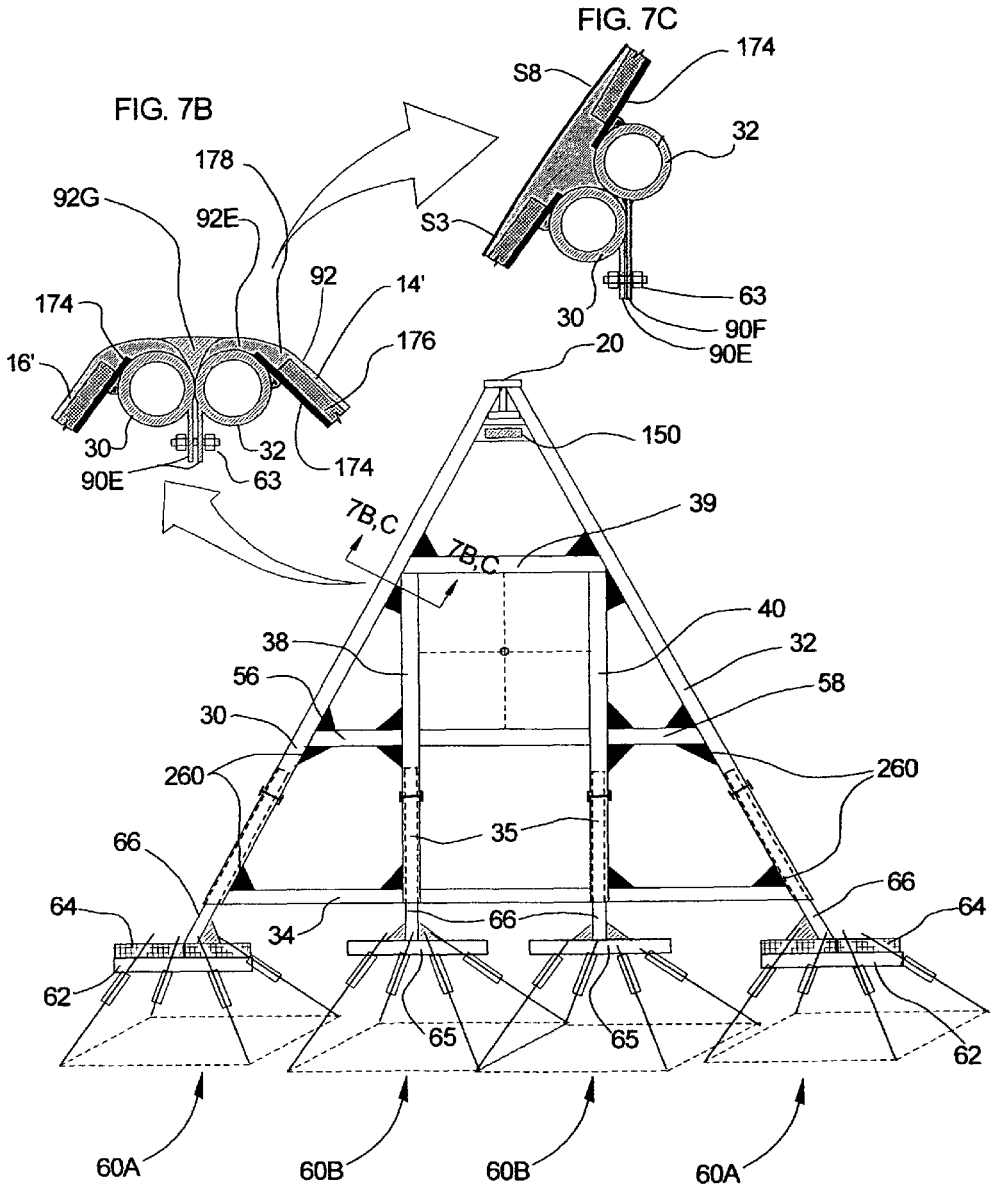
FIG. 7A is a front, elevational view of the frame portion of a side panel of the invention, which side panel includes a removable, access hatch, depicting the side panel installed on-site and attached to anchor plates secured to a ground surface by rebar.
Figure 9A:
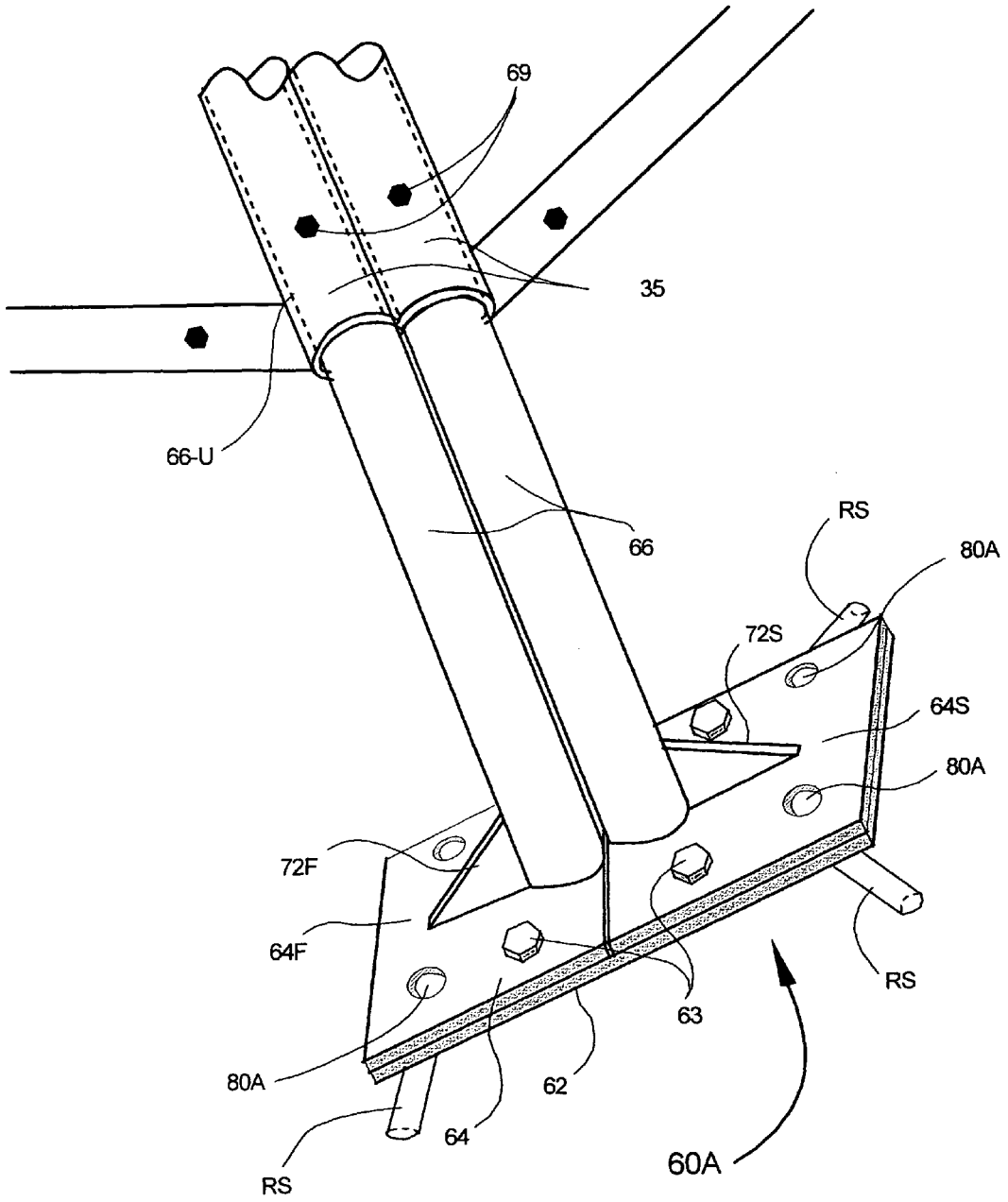
FIG. 9A is an enlarged, fragmentary front perspective view of the front, right corner anchor assembly and the attached frames of the front and right side panels of the assembled, second embodiment, square pyramid shelter depicted in FIG. 1B, prior to on-site expansion of said square pyramid shelter into a double square pyramid shelter.

Referring to FIGS. 4A, 7A, and 9A, it is seen that each corner anchor assembly 60A includes a horizontal, lower anchor plate 62 and a horizontal, split, upper anchor plate 64 comprising a first, 0.75-inch thick, steel upper plate 64F and a second, 0.75-inch thick, steel upper plate 64S in side by side relation, and preferably coplanar. The first and second upper plates 64F, 64S are reversibly attachable by fasteners (e.g., nuts and bolts, 63) to the lower anchor plate 62. An upstanding, cylindrical anchor rod 66 is attached to an upper surface of each of the first and second upper plates 64F, 64S at a 60 degree angle with respect to those plates. First and second, triangular gusset plates 72F, 72S are attached (e.g., by welds) to the upper surfaces of the first and second upper plates 64F, 64S and to the first and second anchor rods 66, respectively, to strengthen the attachment of the anchor rods to said plates. The external diameter of each of the anchor rods 66 is only slightly smaller than the internal diameter of the hollow, lower ends of each of the first and second beams 30, 32 of a side panel in order to permit insertion of the anchor rods therein during on-site assembly of a shelter, and thereby facilitate a secure coupling of said beams to a corner anchor assembly 60A by, for example, inserting a locking pin 69 through aligned apertures in the anchor rods and lower end portions of the side beams. It will be understood that, instead of being cylindrical, the hollow, lower ends of the side beams 30, 32 of each panel could have square, rectangular or other kinds of lateral cross-section through said beams, in which case the anchor rod 66 of each corner assembly 60A will be similarly shaped for close-fitting insertion therein.

Figure 8A:
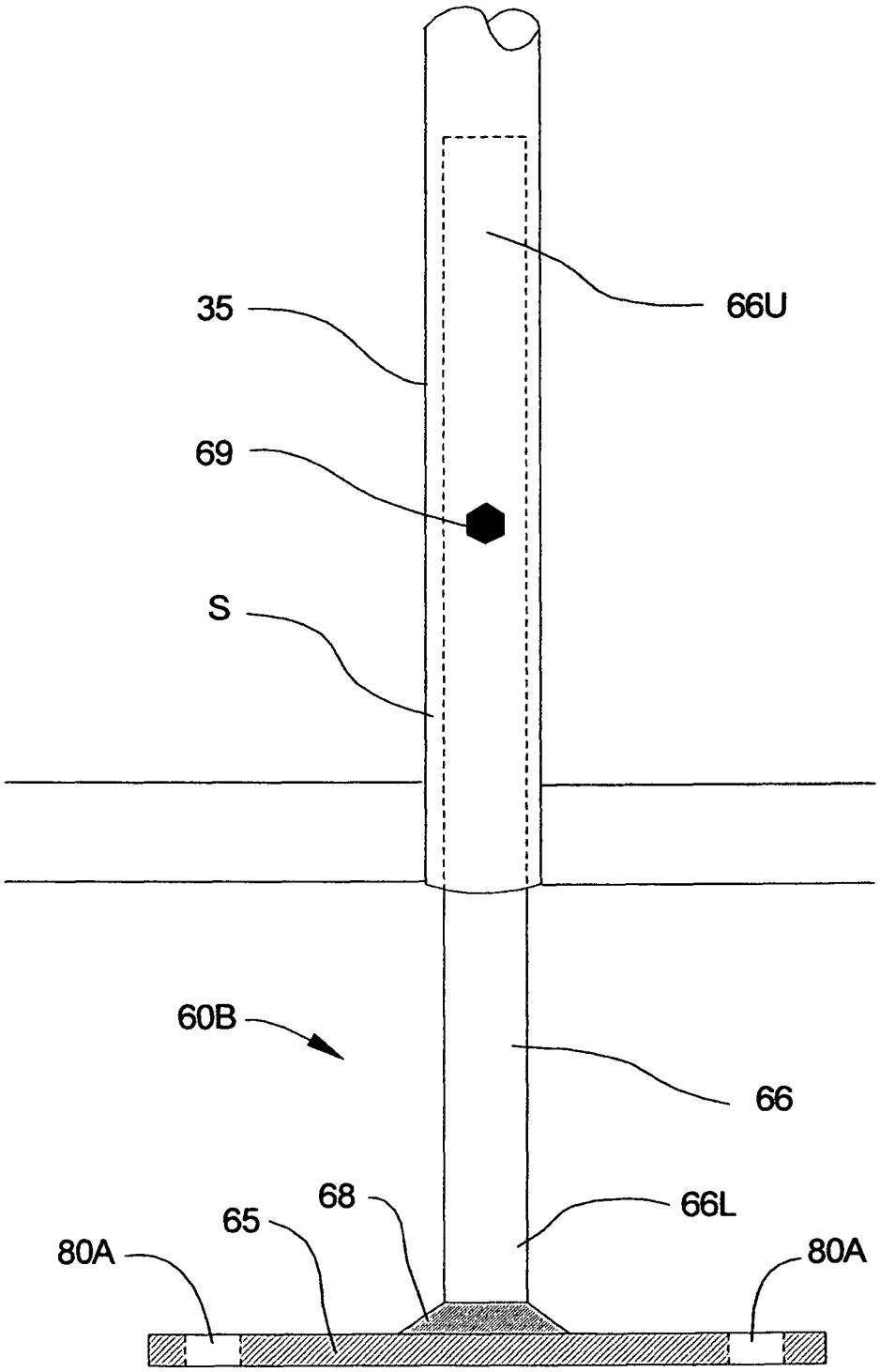
FIG. 8A is an enlarged, fragmentary, front, elevational view depicting a frame member of a side panel of the invention and the manner of its attachment to a mid-base anchor plate.
Figure 8B:
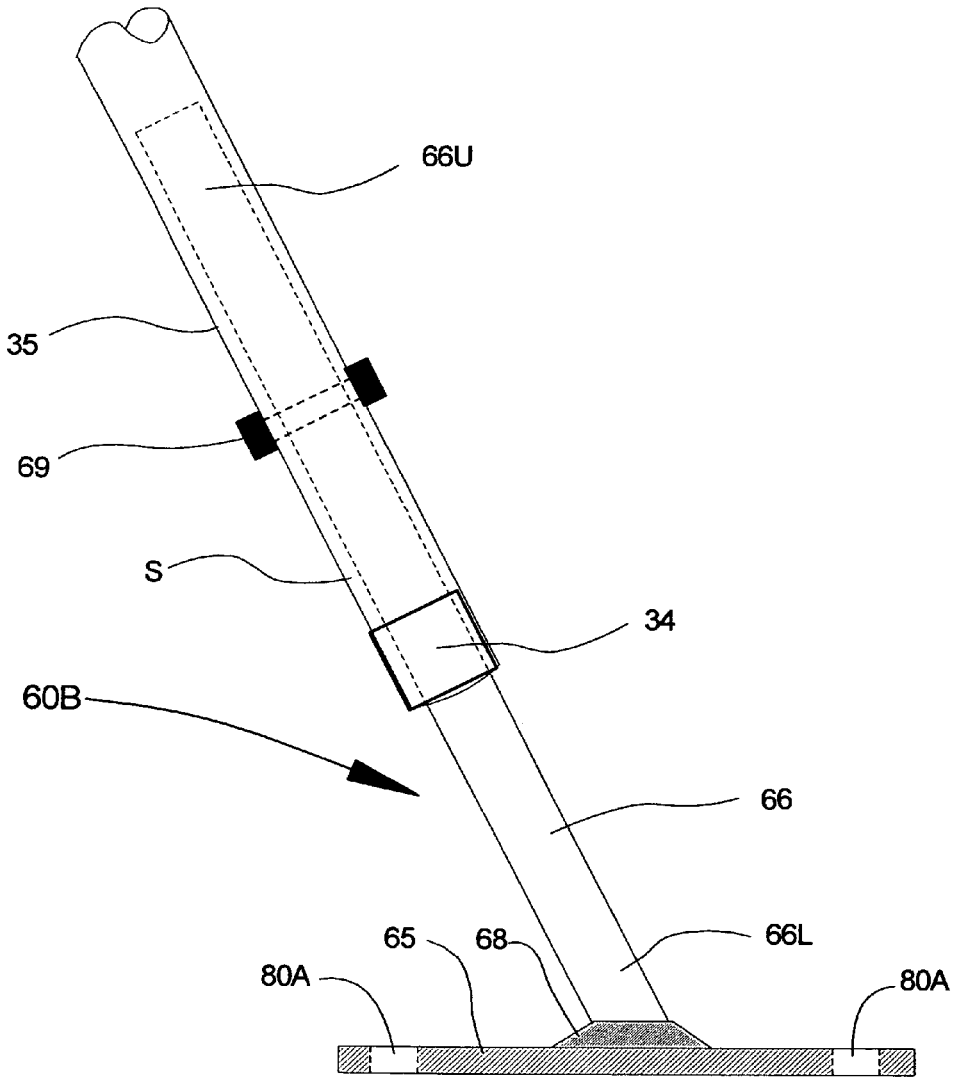
FIG. 8B is a fragmentary, left side, elevational view thereof.

Referring again to FIG. 7A, it is seen that each of the two mid-base beam anchor assemblies 60B is disposed immediately below, and secured to, a jamb 38, 40 in order to support the weight thereof. As shown in FIGS. 8A, 8B, each mid-base anchor assembly 60B further includes a single, horizontal plate 65 having a pair of laterally spaced-apart rebar apertures 80A. Each anchor assembly 60B further includes an upstanding, cylindrical anchor rod 66 attached at its lower end 66L by a weld 68 to an upper surface of the plate 65. A lower portion 35 of each of the jambs 38, 40 preferably comprises hollow, cylindrical steel pipe. The diameter of each of the anchor rods 66 is less than the internal diameter of the hollow lower end portions of the jambs 38, 40, thereby permitting the insertion of an anchor rod of each mid-base beam anchor assembly 60B into, and telescopic movement of said rod within, a hollow, lower end 35 of each of each of the jambs 38, 40. The telescoping movement of the anchor rods 66 within the lower ends 35 of the jambs 38, 40, together with the telescoping movement of the anchor rods 66 of the corner anchor assemblies 60A within the side beams 30, 32 of side panels, permits use of the anchor assemblies 60A, 60B on uneven and/or sloped, on-site ground surfaces, and, once the position of the anchor rods within the mid-support beams has been properly adjusted so that the base beams 34 are horizontal, the rods 66 can be firmly fixed in place by threading locking bolts 69 through a mating, threaded aperture in the lower end 35 of each Jamb 38, 40.

The corner anchor assemblies 60A and the mid-base anchor assemblies 60B have a plurality of rebar apertures 80A (e.g., four) that extend vertically through both their lower plates 62 and their upper plates 64. During on-site installation of a shelter 10, 100 rebar 80 (e.g., one-inch diameter rebar) is inserted down through each of the rebar apertures 80A at a 45° outward angle from vertical and driven deep enough underground to adequately secure the anchor assemblies 60A, 60B to the ground surface G—which, in some cases, might be as deep as 10 feet or more below ground surface. Ordinarily, the rebar 80 can be driven into the ground G with a five or ten pound sledge hammer or with a modified jack hammer for larger structures. This provides the required strength of attachment to the ground G without the need to pour a concrete foundation.

In a second embodiment 100, the same components of the system may be assembled on-site to form a square pyramid shelter 100 as depicted in FIG. 1B, comprising a front side panel 16', a right side panel 14', a rear side panel 12' and a left side panel 17'. The base beam 34 of each of those panels is aligned along one of the four edges of a square and the apex 20 of each of those panels is inclined inwardly to meet at a common, pyramidal apex. The foregoing comments regarding the component parts and manner of assembly of a triangular pyramid shelter 10 apply to the structure and on-site assembly of a square pyramid shelter 100, except that assembly of the latter requires four side panels and corner anchor assemblies instead of three side panels and three anchor assemblies and, optionally, eight mid-base anchor assemblies instead of six mid-base anchor assemblies.

The side panels 12, 14, 16 (or 12', 14' 16', 17') can range in height, for example, from 72 inches up to 144 inches or more, measured from base beam 34 to apex 20. The joinder of the beams 30, 32, 34 to one another and of the reinforcement struts 36, 40, 42, 44 (FIG. 4A) to the beams, is preferably by deep welding, but other joinder means known to persons of ordinary skill in the art of hardened shelters for above-ground structures is within the scope of the invention as well. The beams 30, 32 and jambs 38, 40 preferably comprise schedule 80 round or square tubes having internal and external widths or diameters to provide adequate strength and rigidity for the intended use of the shelter 10.

Figure 7E:
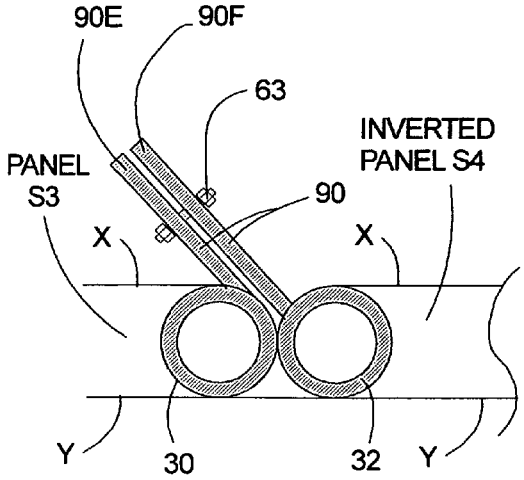
FIG. 7E is an enlarged, fragmentary, cross-sectional view taken along line 7E-7E of FIG. 2, showing 45-degree steel strapping of a right edge of side panel S3 overlapping and joined to 45-degree steel strapping of a left edge of an inverted side panel S8.
Figure 7F:
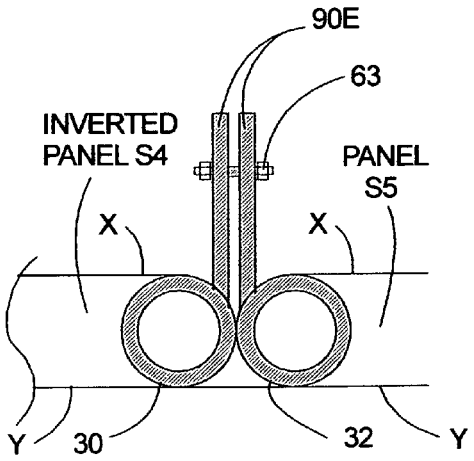
FIG. 7F is an enlarged, fragmentary, cross-sectional view taken along line 7F-7F of FIG. 2, showing 90-degree steel strapping of a right edge of inverted panel S8 overlapping and joined to apertured, 90-degree steel strapping of a left edge of expansion side panel S5.
Figure 7D:
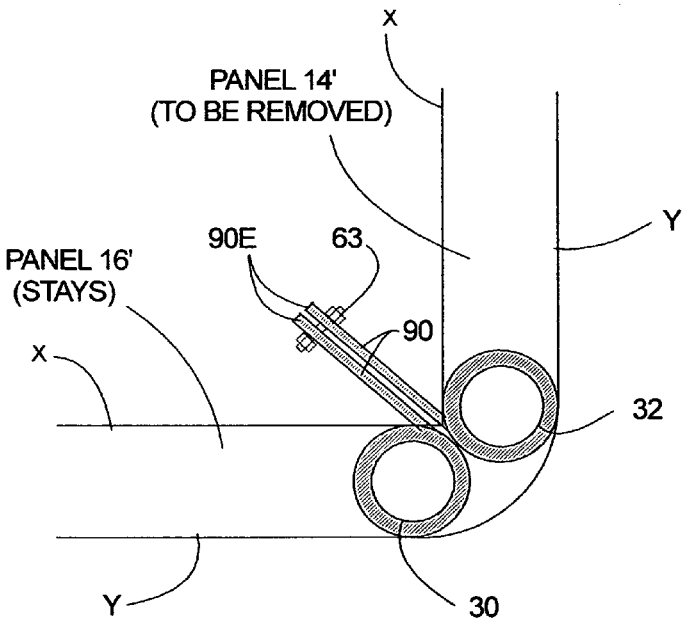
FIG. 7D is a further enlarged, fragmentary, cross-sectional view taken along line 7D-7D at a right, front corner of the installed, on-site square pyramid shelter depicted in FIG. 1B, prior to beginning to expand it into a double square pyramid shelter by removal of right side panel 14'.
Figure 7H:
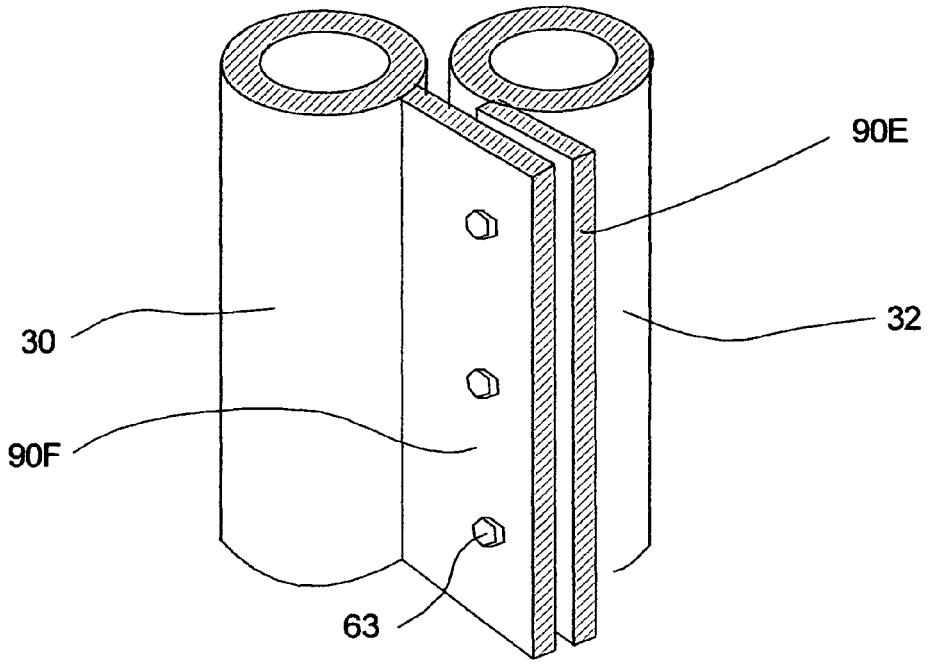
FIG. 7H is a further enlarged, fragmentary, perspective view of the side beams of FIG. 7E joined by apertured, overlapping, 45-degree steel strapping attached to each of the side beams.
Figure 10A:
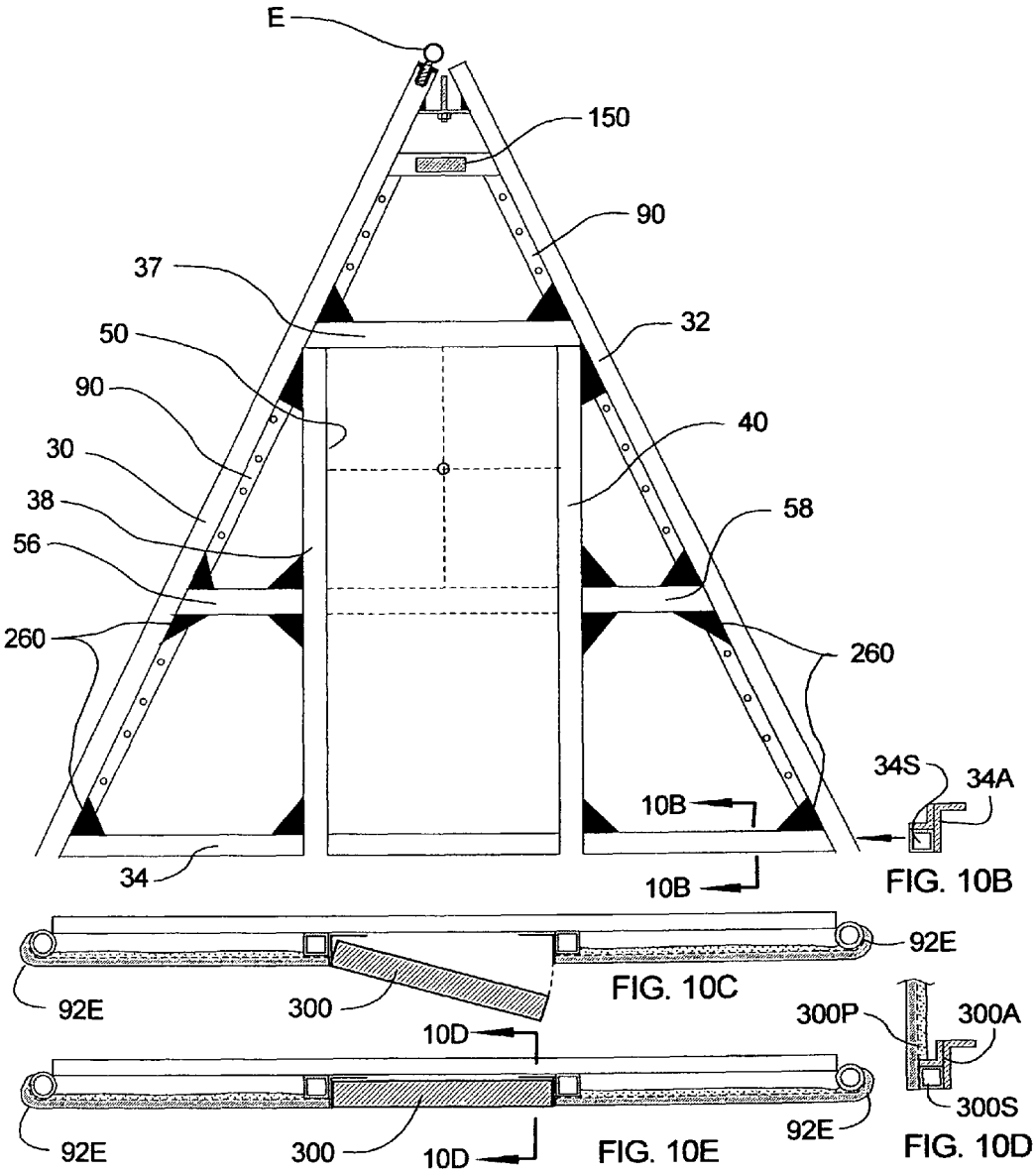
FIG. 10A illustrates the frame portion of a side panel having a door opening to which either a door or an access hatch may be attached, as indicated in phantom outline.

As shown in FIGS. 7B and 10A, attached to, and extending along the length of, each of the first side beam 30 and the second side beam 32 are steel strapping 90 welded to an outer edge surface of each of said beams, terminating in an apertured end 90E. When a pair of side panels (e.g., side panels 12, 14) are positioned and abutted one to another to form two adjoining sides of the pyramidal form of a shelter, as depicted in FIG. 7B, for example, for the case of a square pyramid shelter 100, the first beam 30 of the side panel 12 is likewise abutted against the second beam 32 of the third side panel 16 and their respective apertured strapping ends 90E are likewise overlapped and their apertures aligned. Because adjacent pairs of side panels (i.e., 16' and 14,' 14' and 12', 12' and 17', 17' and 16') of a square pyramid shelter are oriented perpendicular to each other at each of the four corners thereof, the angle between each of those pairs of panels is 90 degrees;

FIG. 7D. For the adjacent steel strapping 90 to overlap and the apertures thereof to align in registry on the interior of each corner of a square pyramid shelter 100, the steel strapping 90 must extend tangentially with respect to the side beam 30, 32 to which it is attached and interiorly and proximally at a 45-degree angle with respect to an interior surface X of the side panel to which it is attached in order to bisect the 90 degree angle at each corner; this is depicted, for example, in FIGS. 7B and 7D. Here the term "interiorly" means directed away from the exterior surface X of the panel and toward the interior of the shelter once the shelter has been assembled, and the term "proximally" means the angle between the steel strapping 90 and an interior surface X of the panel to which it is attached is an acute angle. By securing the plurality of overlapped strapping ends 90E to each other with fasteners (e.g., 3 inch by 0.375 inch diameter heat-tempered bolts 63 and nuts with mating thread) inserted through the aligned apertures thereof, front side panel 16' is secured to right side panel 14,' right side panel 14' is secured to the rear side panel 12', and the rear side panel 12' is secured to the left side panel 17' within the interior of the shelter 100.

Figure 7G:
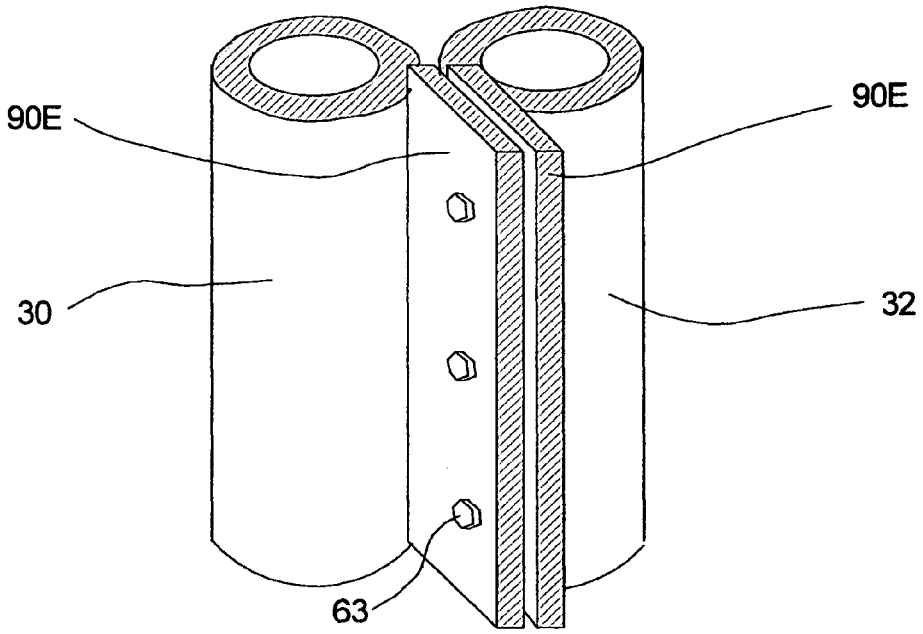
FIG. 7G is a further enlarged, fragmentary, perspective view of the side beams of FIG. 7F joined by overlapping, apertured, 90-degree steel strapping attached to each of the side beams.
Figure 7I:
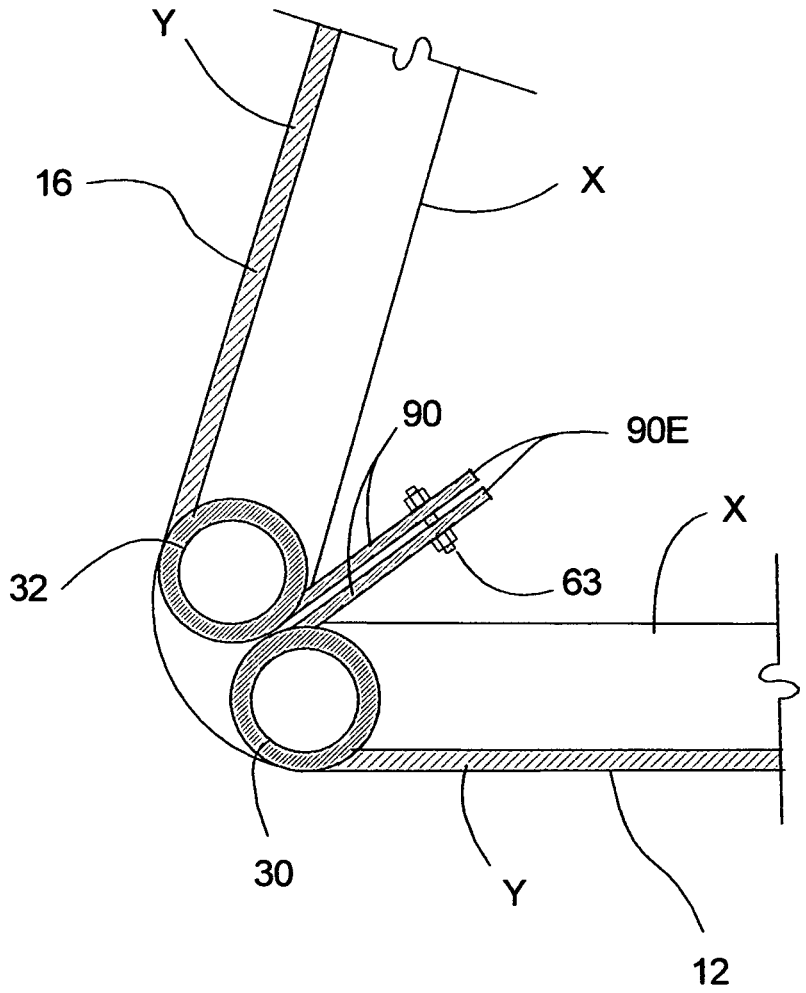
FIG. 7I is a lateral cross-sectional view taken along line 7I-7I of FIG. 1A, showing a corner of the installed, on-site triangular pyramid shelter depicted in FIG. 1A.

Similarly, in the case of an assembled triangular pyramid shelter 10, adjacent panels at each of the three corners each form a 60 degree angle; therefore, the steel strapping 90 attached to each of the side beams 30, 32 of each of the side panels 12, 14, 16 must extend tangentially with respect to the side beam to which it is attached and interiorly and proximally at a 30-degree angle with respect to the interior surface X of the side panel to which it is attached in order to bisect the 60 degree angle at each corner; see, for example, FIG. 7I.

In addition to forming the frames for each of the side panels 12, 14, and 16, or 12', 14', 16' and 17', factory prefabrication of said panels includes attaching an exterior covering to each of the panel frames. The type of covering that is attached to the frames depends upon the intended use of the shelter 10, 100 as well the kinds of physical hazards it will need to withstand. In some cases, flat steel plate is welded to the frames 12, 14, 16, or 12', 14', 16', 17', except over the doorway openings 50 and access hatch openings 13. Thus, in FIG. 7B, the infill spaces along the exterior surfaces of the abutted, secured beams 30, 32 is covered with flat steel plate 92 welded to said beams. Side edge portions 92E of the steel plates 90 are tapered and contoured for mating engagement with the round exterior surfaces of the beams 30, 32. The resulting gulley or gap 92G is thereafter filled once the rest of installation of the shelter has been completed, using the same fillers and/or coatings that have been elsewhere applied to the exterior of the shelter. In other cases, diamond steel mesh is welded to the frames and, thereafter, infill material is added to the mesh, such as polyester resin with saturated "E" chopped fiberglass and/or 24 oz. woven roving of the kind used on boat decks. The infill material is either sprayed on or laid and rolled onto the diamond steel mesh on both its interior surface X and exterior surface Y. A final coating over the infill material advantageously includes a Mineral Rock formulation comprising a variety of sand, rock fragments, and bonding material. Further enhancements to the final coating can include specialty pigments and Gel Coat Resin combined in a matrix that is sprayed onto an exterior surface of the "E" fiberglass coating. If the shelter 10, 100 is required to be fire-resistant, the infill material would preferably instead be GFRC fiber-reinforced cement. A preferred mixture of GFRC fiber-reinforced cement comprises one part cement, one or two parts silica sand and 5 percent alkaline-resistant glass ("ARG") by weight of the cement content, mixed to form a matrix, then sprayed or laid on the infill areas of the diamond steel mesh by trowel or chopper gun using the same method as is used for the polyester resin mixture, described above.

Figure 12:
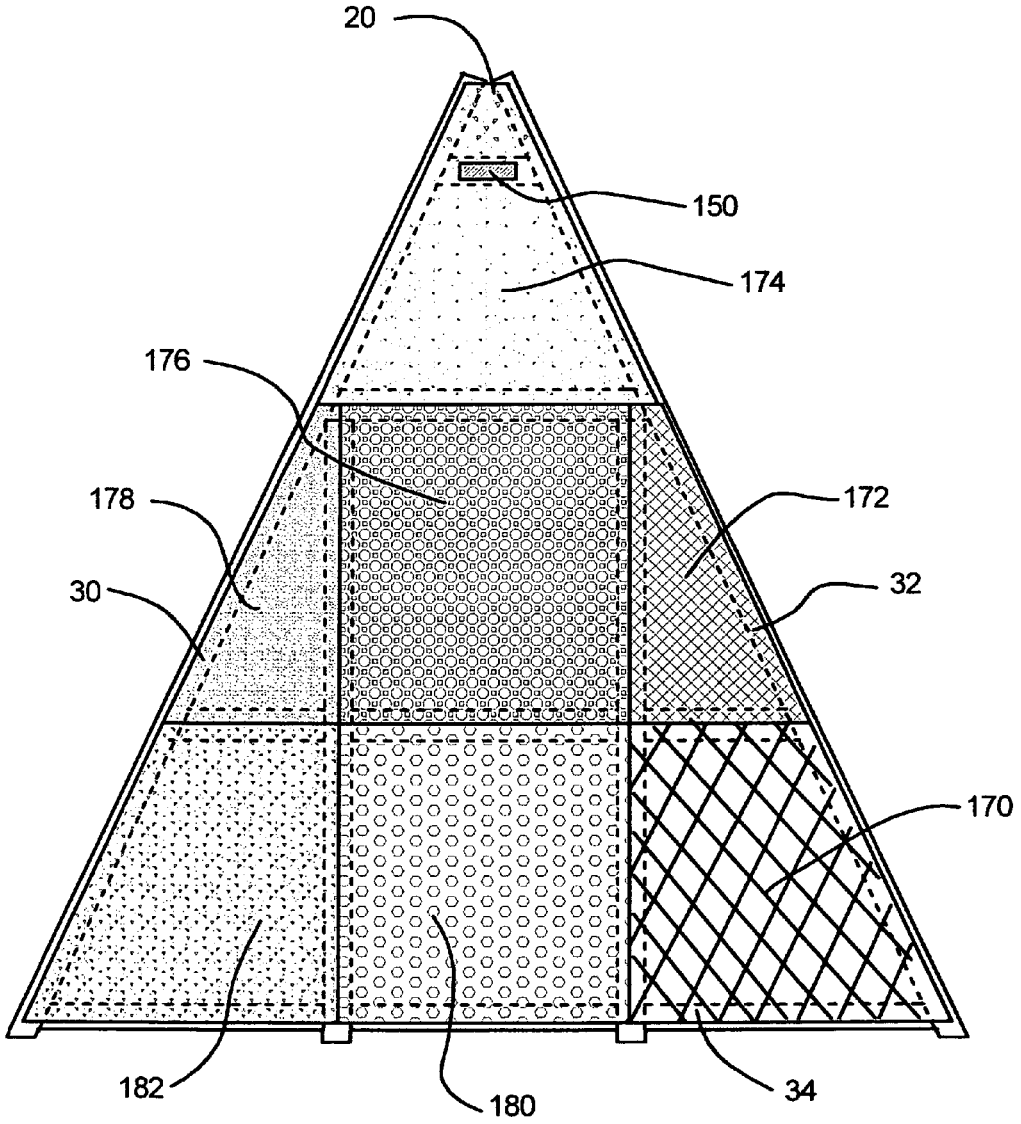
FIG. 12 is a side panel of the invention, depicting schematically the various kinds of infill that can be incorporated into the panel.

FIG. 12 illustrates some of the kinds of infill that may be applied to a panel, depending upon its intended location and uses, as follows: heavy duty, large, raised diamond mesh materials 170 welded to a tubular, panel frame; small, 1-inch, raised diamond mesh materials 172; perforated ⅛-inch thick steel plate 176; ⅛-inch thick steel plate 178; heavy, perforated, ⅜-inch steel plate with 0.5-inch holes 180; and perforated, corrugated, 1-inch thick steel sheet 182. For exceptional blast and ballistic protection, 0.25-inch thick, high strength steel plate 174 is welded to the frame of a panel. Then a blast and ballistic resistance panel layer (e.g. CEASE Blast™ Armor panels available from Touchstone Research Laboratory, Ltd., of Triadelphia, W. Va.) is secured to the steel plate 174 with an industrial-strength adhesive. Finally, RHINO TUFF STUFF®, RHINOARMOR® PPFR 1150 178, or other elastomeric polyurethanes having equivalent hardness, tensile strength, elongation (%), compressive strength, Taber abrasion resistance and tear resistance, and dissipation factor under applicable ASTM test standards, is then sprayed over the entire structure for further protection. Taber® is a registered trademark of Taber Instrument Corporation of North Tonawanda, N.Y. RHINO TUFF STUFF® and RhinoArmor® are registered trademarks of Rhino Linings USA of San Diego, Calif. Alternatively, for blast protection, a low-density, impact energy-absorbing, structural carbon foam layer, such as CFOAM®, is attached to exterior surfaces of the steel plates. CFOAM® is a registered trademark of Touchstone Research Laboratory, Ltd., of Triadelphia, W. Va. Methods for preparing CFOAM® and similar low-density, impact energy-absorbing, non-combustible, structural carbon foams of the kind intended for use in the present invention are disclosed in U.S. Pat. Nos. 6,681,151 B1, 6,689,470 B1, 6,814,765 B1, 6,833,012 B2, 6,656,239 B1, and 6,656,238 B1. CEASE Blast™ panels provide blast mitigation through energy absorption, accomplished through a proprietary engineered combination of energy mitigating units and a matrix comprising CFOAM carbon foam, polyurea or other energy-absorbing matrix material, which matrix may also include fire retardants, heat-reducing agents and/or be reinforced with polymeric fibers, as disclosed in U.S. Pat. Nos. 7,736,729 and 8,071,206. CEASE Blast™ is a trademark of Touchstone Research Laboratory, Ltd., of Triadelphia, W. Va. As used herein, the term "blast-resistant panel" means any panel, including any CEASE Blast™ panel, that comprises any blast energy mitigating composite disclosed and claimed in U.S. Pat. Nos. 7,736,720 and/or 8,071,206.

FIG. 2 shows a third embodiment of a shelter 200 assembled by the modular system of the present invention enclosing and protecting above-ground, oil pipeline pressure gauges 102, depicted in phantom outline. In this case, a single triangular tetrahedral shelter 10 or square pyramid shelter 100 was not large enough to accommodate the gauges 102 so a double square pyramid 200 was assembled instead. In order to assemble this larger shelter 200 on-site for the pressure gauges 102, modular components of the system sufficient to assemble two square pyramid shelters were transported to the site. Referring to FIG. 3A, to assemble a double square pyramid shelter 200, three side panels S1, S2, S3 of a first, incomplete, square pyramid shelter SP1 are erected on-site on a first, square base (left side of FIG. 3A), three side panels S5, S6, S7 of a second, incomplete square pyramid shelter SP2 are erected on an adjacent, second square base sharing two common corner anchor assemblies 60A (not shown), their bases abutting one another along a common line of joinder J. A triangular side panel S4 is initially withheld from the first incomplete, square pyramid shelter SP1, and a triangular side panel S8 is initially withheld from the second, incomplete, square pyramid shelter SP2, thereby leaving the two incomplete, square pyramid shelters with triangular openings T1, T2 oppositely-facing across the line of common joinder J. This also leaves a pair of triangular gaps, disposed at opposite ends of the line of joinder 3, between the first and second incomplete pyramids, which triangular gaps share a common base, denoted by the dashed line B in FIG. 3A. To complete the double square pyramid shelter, the two withheld side panels S4, S8 are then inverted and inserted into the triangular gaps between the first and second incomplete, square pyramid shelters, and joined thereto, such that the base beams 34 of the inverted panels lie along the dashed line B and join the apexes 20, 20 of said first embodiment shelters 100, 100, and the apexes 20, 20 of the inverted panels S4, S8 lie on the line of joinder J. The on-site assembly of this expanded shelter 200 is facilitated, of course, by the split-plates 64F, 64S and the upstanding, anchor rods 66 attached to them that are integral parts of each of the corner anchor assemblies 60A, whereby adjacent corners of the square pyramid shelters 100, 100 are able to share, and be supported by, the same corner anchor assembly 60A. FIG. 3B depicts a similar expanded shelter 200 enclosing and protecting an above-ground, oil pipeline valve 104, depicted in phantom outline. In this manner, the modular components sufficient to construct two complete, square pyramid shelters, each comprising a second embodiment of the invention, can be combined to construct on-site a third embodiment of the invention comprising a double square pyramid shelter 200. Similarly, such a double square pyramid shelter 200 can be further enlarged (not shown) by joining to it modular components of the system for one or more additional square pyramid shelters using the split plates 64F, 64S that permit adjacent side panels of incomplete square pyramid shelters to share their corner assemblies 60A.

Figure 9B:
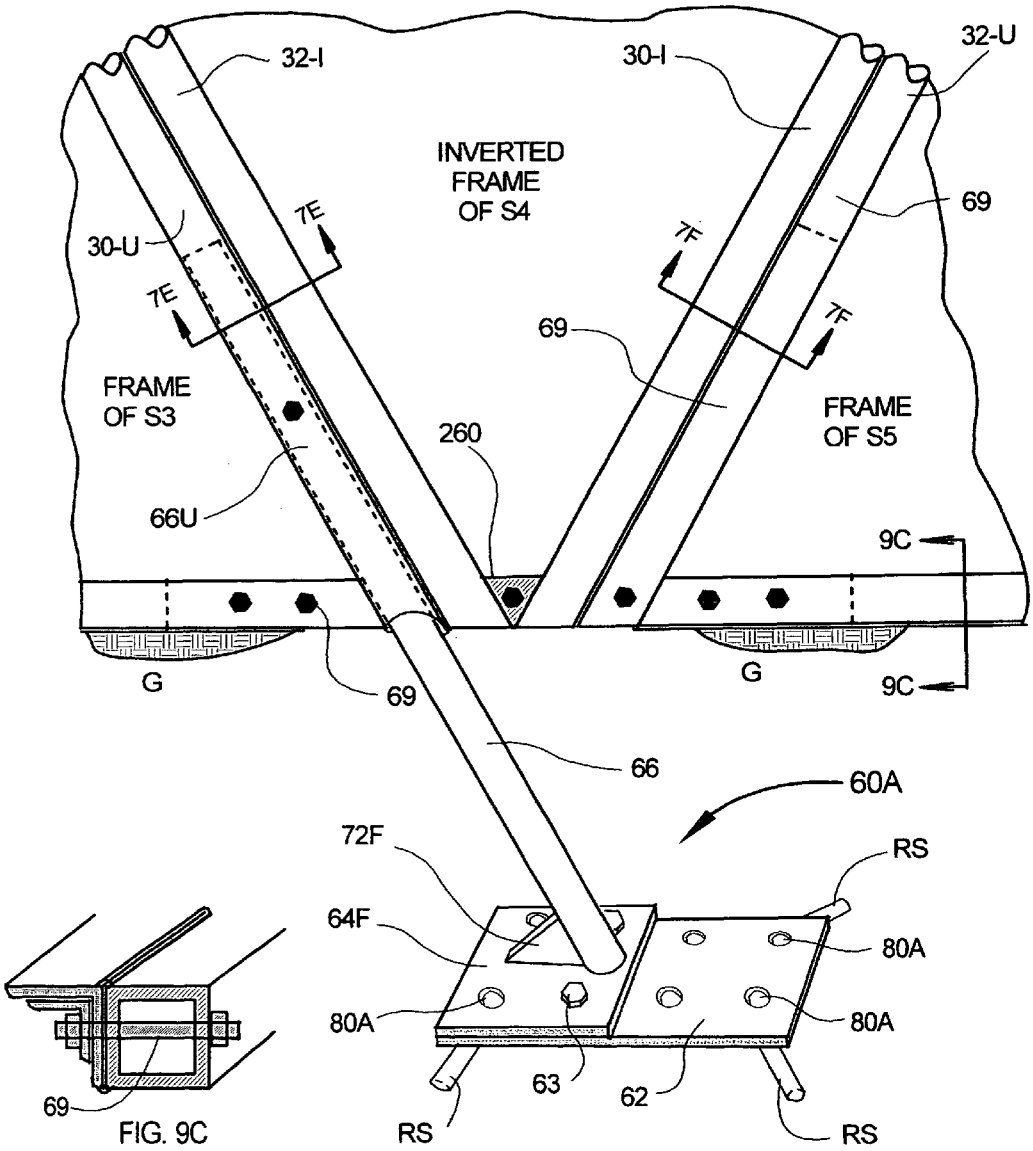
FIG. 9B depicts the same corner anchor assembly in fragmentary, front perspective view after an inverted expansion panel S8 and another expansion panel S5, as depicted in FIG. 3, have been joined thereto, in the process of expanding the square pyramid shelter of FIG. 1B into a double square pyramid shelter as depicted in FIGS. 2, 3A, 3B and 4C.

The method to expand the square pyramid shelter 100 depicted in FIG. 1B into a double square pyramid 200, such as that depicted in FIG. 2 or 3B, will include the same steps as that for assembling a double square pyramid set forth above, except that the first incomplete square pyramid SP1 is attained merely by removing one of the four side panels (e.g., right side panel 14') of the existing, on-site square pyramid to create a triangular opening T1, adding at the resulting open side a second incomplete, square pyramid SP2, and filling in the resulting two triangular gaps with two, inverted side panels S4, S8, as depicted in FIG. 3A. In this process, each of the two inverted side panels S4, S8 will have one of its side beams 32-I attached at the line of joinder J to a beam 30-U of adjacent side panel S3 (previously denoted as panel 12') of the original square pyramid shelter 100, and to an opposite side beam 30-I of that inverted side panel S8 will then be attached a new, expansion side panel S5; FIG. 9B. The first upper plate 64F of the corner anchor assembly 60A at that corner location remains in place (FIG. 9B), supporting side panel S3; whereas, the second upper plate 64S has been removed (FIG. 9B) at the time the side panel 14' was removed to form the first incomplete square pyramid shelter SP1. In this manner, the upper split plate 64 of a corner anchor assembly 60A simplifies and facilitates the expansion of a square pyramid shelter 100 to a double square pyramid shelter 200. Of course, as will be evident to a person of ordinary skill, in a similar manner a double square pyramid shelter 200 can be further expanded to assemble on-site a triple square pyramid shelter (not shown), and so on.

To expand an assembled square pyramid shelter 100 into a double square pyramid 200, a side panel, for example, the right side panel 14' of the square pyramid shelter (FIG. 1B), is first removed to form a first, incomplete square pyramid shelter SP1. To remove that side panel 14', any exterior coating that overlies the gap 92G (FIG. 7B) between adjacent side panels is cut away, the anchor rods 16 at the front right and rear right corner anchor assemblies 60A are disattached from the hollow lower ends of the base beams 30, 32 of that side panel, all fasteners 63 that secure that panel to adjacent side panels are removed, and the panel is lifted away from the now incomplete square pyramid shelter SP1. The second upper plates 64F, 64S to which those anchor rods 66 were attached are also removed from the same anchor assemblies 60A (FIG. 9B) and remain attached to the lower ends of those anchor rods. Next, a left edge of an inverted side panel S4 is attached to a right edge of the front side panel; FIG. 9B. Referring to FIG. 7E, when inverted side panel S4 is joined to a first, incomplete square pyramid SP1 (FIG. 3A), it forms an oblique edge 201 and a 180 degree angle with the remaining front panel S3 of the first, incomplete square pyramid SP1—that is, side panels S3 and S4 are then coplanar. The steel strapping 90 at a right edge of front panel S3 is oriented interiorly and proximally at a 45 degree angle with respect to panel S3 because, before right side panel 14' was removed, it formed a square corner with that panel (FIG. 7D), and a left edge of inverted side panel S4 must have its steel strapping 90 oriented to overlap steel strapping at the right edge of side panel S3. Accordingly, a left edge of inverted side panel S4 has steel strapping 90 oriented interiorly and distally at a 135 degree angle with respect to an interior surface of side panel S4, and overlaps the steel strapping of the right edge of panel S3; FIG. 7E. In order to achieve the desired overlap, at each 180 degree junction of adjacent side panels, the width of the steel strapping 90F attached to one of the joined side beams 30, 32 will be somewhat wider than the steel strapping 90E attached to the adjacent side beam (FIG. 7H); whereas, in the case of overlapping of 90-degree steel strapping, the steel strapping can have equal widths (FIG. 7G). The term "distally" here means that the steel strapping 90 forms an obtuse angle with respect to an interior surface X of the side panel to which it is attached. The left edge of the inverted side panel S4 is then joined to the right edge of side panel S3 with fasteners 63 inserted through the plurality of aligned apertures in the steel strapping 90. Next, a left edge of an expansion side panel S5 similarly must be joined with fasteners 63 to a right edge of the inverted side panel S4 such that those panels will also be coplanar. To join a left edge of side panel S5 to a right edge of the inverted side panel S4 at a 180 degree angle between those panels, the steel strapping 90 on the right edge of inverted panel S4 is oriented interiorly and at 90 degrees with respect to panel S4, and the steel strapping 90 on the left edge of panel S5 is oriented interiorly and at 90 degrees with respect to panel S5. Of course, in order to form a square corner with side panel S6, the steel strapping at the right edge of panel S5 is also oriented interiorly, proximally and at 45 degrees with respect to an interior surface X of panel S5; FIG. 7D. The installation of the rear, inverted side panel S8 between edges 205 and 206 (FIG. 3A) proceeds in a similar manner, such that side panel S8 is coplanar with side panels S1 and new side panel S7 and cooperate to form edges 206 and 205, respectively, of the double square pyramid shelter 200; FIG. 3A.

Figure 11:
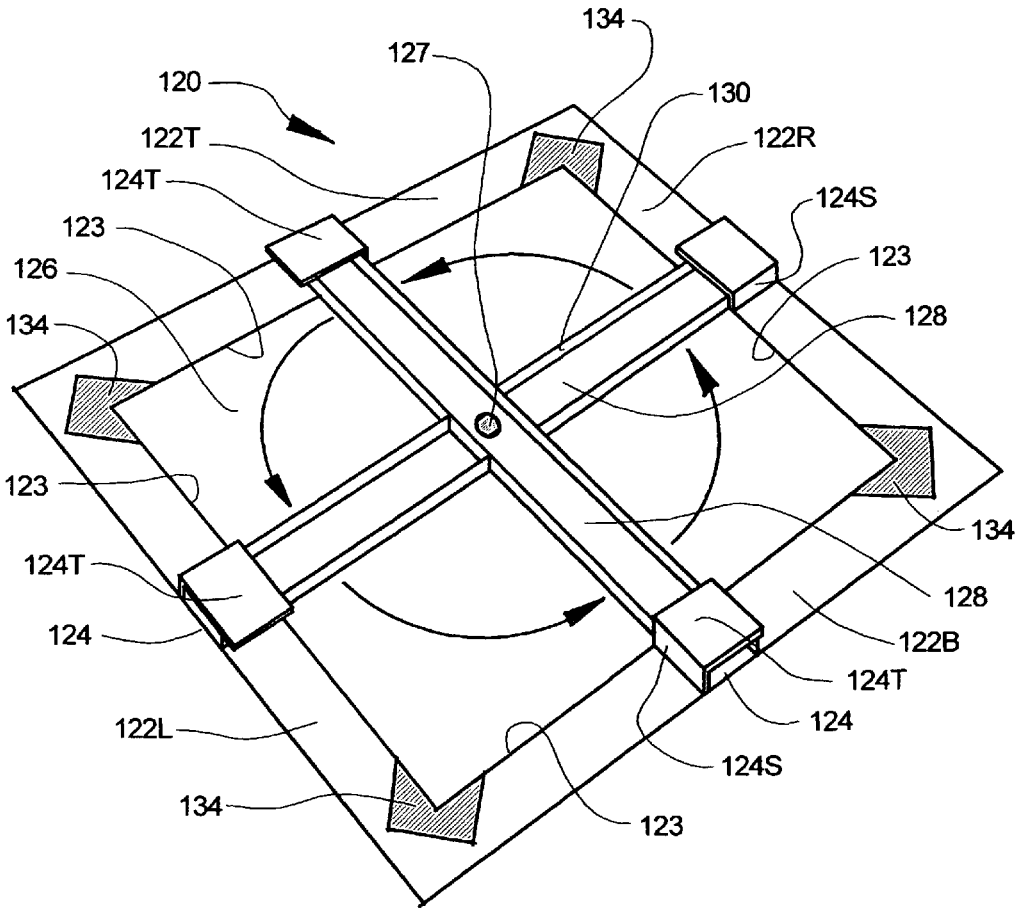
FIG. 11 is a perspective view of an interior side of an access hatch of the invention.

An access hatch 120 that can be installed in an access hatch opening 13 of a side panel 12 is depicted in FIG. 7A (exterior view) and in FIG. 11 (interior view). The access hatch 120 comprises a flat, square-annular, hatch frame 122 that defines a square, centrally-disposed opening 123; that is, the frame has the shape of a square annulus and includes a top member 122T and a bottom member 122B joined by a left member 122L and a right member 122R. The frame 122 is welded to an interior surface of the access hatch opening 13 at the square margins of said opening. Attached to an inner surface of each of the members 122T, 122B, 122L, 122R is an L bracket 124. Each L bracket 124 comprises a short stub 124S attached to and normal to an interior surface of one of the members 122T, 122B, 122L, 122R, and a flat tab 124T attached to the stub and interiorly spaced apart from its respective member. The tabs 122T all extend away from their respective stubs 122S in a counterclockwise direction (or, alternatively, all extend in a clockwise direction) as viewed from the interior side of the access hatch 120. The access hatch 120 further includes a square, closure plate 126 that has length and width slightly greater than the length and width of the central opening 123. A cross-shaped locking element 130, comprised of two equal-length arms 128 perpendicularly attached to each other, is rotatably mounted by a pivot pin 127 to the closure plate 126 at the intersection of said arms. The lengths of each of the arms is slightly less than length and width of the frame 122, such that rotation of the locking element 130 in a clockwise direction will move the arms 128 into locking engagement with the L brackets 124; whereas, rotation of the locking element 130 in a counterclockwise direction will thereafter disengage the arms 128 from the L brackets 124. The frame 122 has rectangular cut outs 134 at each of its corners. Rotation of the locking element 45 degrees counterclockwise from its locked position aligns the free ends of the arms 128 with the cut outs 134 and permits the closure plate 126 and locking element 130 to be drawn exteriorly through the square access hatch opening 13 and entirely out of the shelter 10. An exterior end of the pivot pin 127 has a key hole 132 so that an authorized person provided with a matching key can, by rotating the key in the key hole, rotate the arms 28 into and out of locking engagement with the L brackets 124. To deter tampering or unauthorized entry into the shelter 10, the exterior surface of the shelter, including the key hole 132, can be camouflaged and/or covered with materials available on-site, such as soil, sand, stones, fallen timber, etc.

Figure 5:
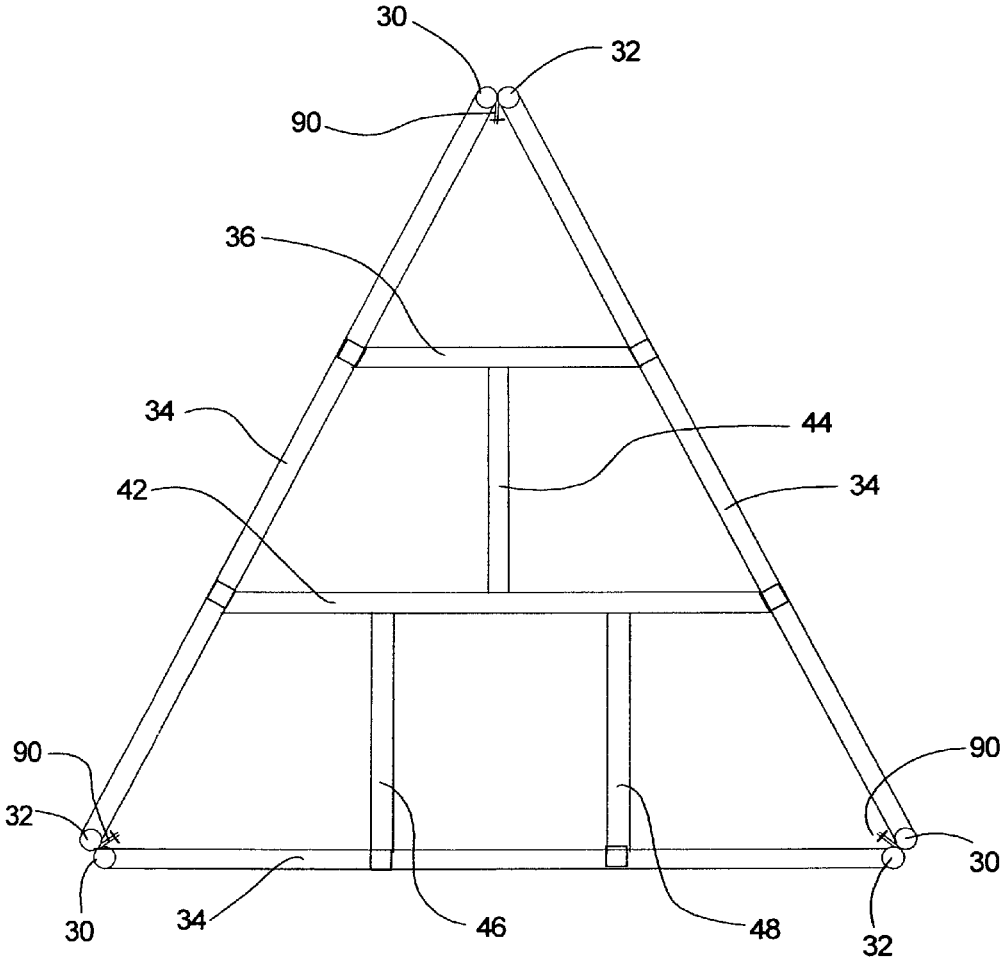
FIG. 5 is a top, plan view of the triangular base portion of the first embodiment of an assembled, triangular pyramidal shelter according to the invention.
Figure 6:
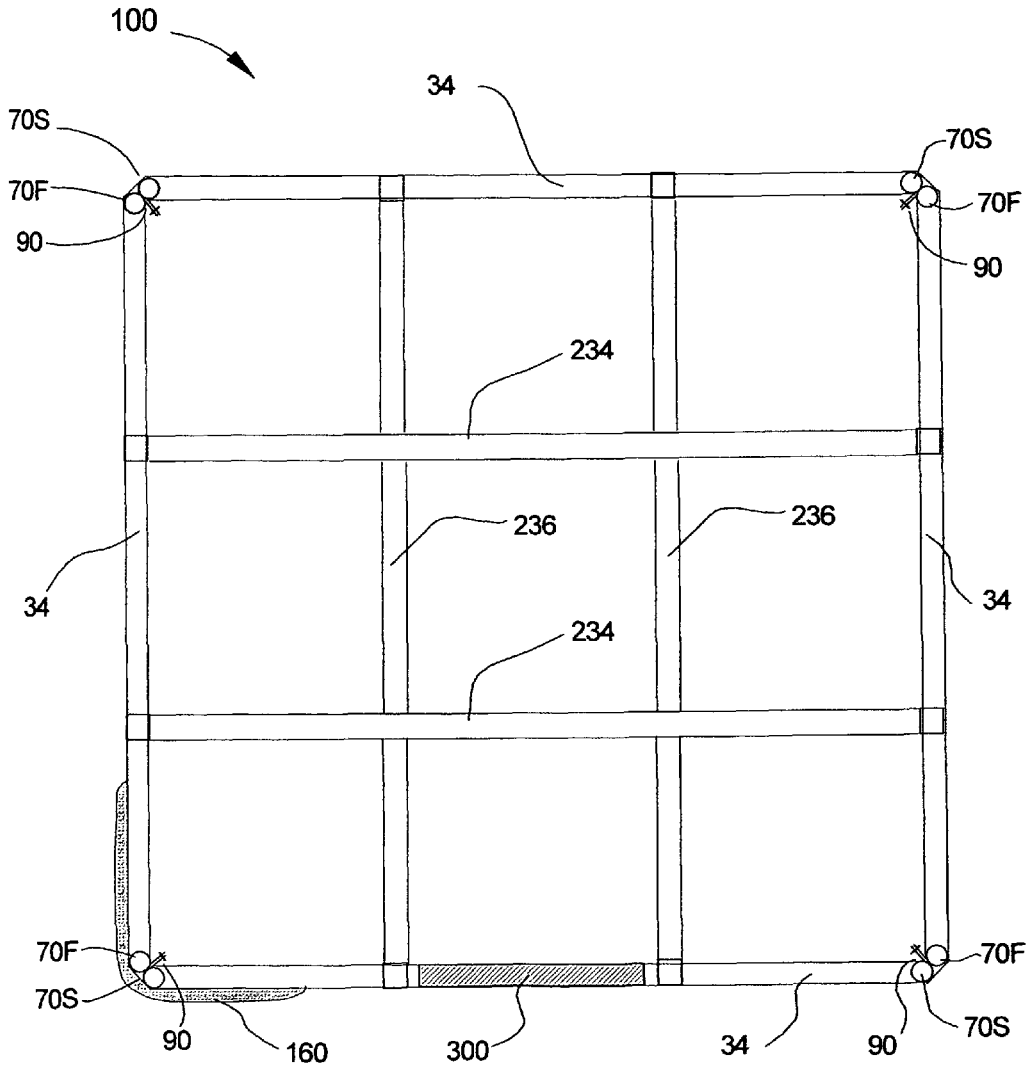
FIG. 6 is a top, plan view of the base portion of a fire-resistant, second embodiment of the invention assembled in the shape of a pyramid having a square base.
Figure 15B:
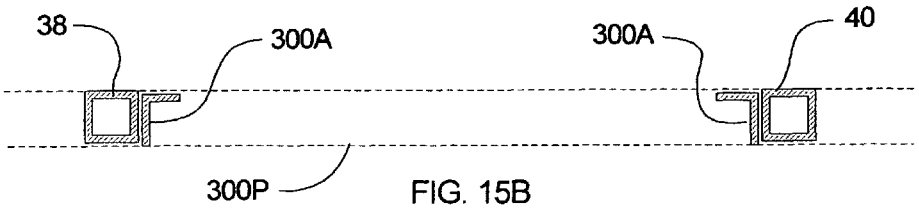
FIG. 15B is a top plan view taken along line 15B-15B of FIG. 15A.
Figure 15A:
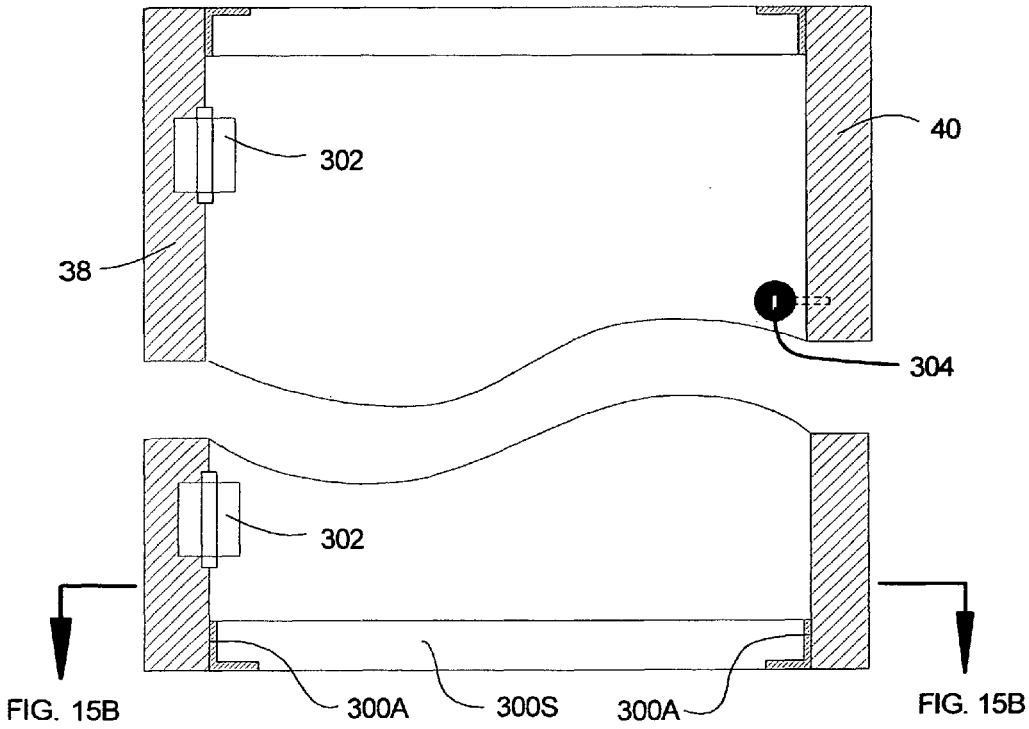
FIG. 15A is an, enlarged, fragmentary, front, elevational view of a side panel that includes a door opening, as illustrated in FIG. 10A, and a door attached thereto by hinges.

Each shelter 10 optionally can further include a floor 200 to prevent intrusion into the shelter from below ground. A frame for a floor for the first embodiment triangular pyramid shelter is depicted in FIG. 5 and is seen to include, in addition to the base beams 34, 34, 34 of the three side panels 12, 14, 16, an orthogonal grid of lateral struts 36, 42 and intersecting longitudinal strut 44, 46, 48. Similarly, a frame for a floor for a square tetrahedral shelter (not shown), is depicted in FIG. 6 and is seen to include the base beams 34 of four side panels and an orthogonal grid that interconnects those base beams, which orthogonal grid comprises longitudinally spaced-apart lateral struts 234 intersecting and attached to laterally spaced apart longitudinal struts 236. Each of the beams 34 and struts 234, 236 preferably comprise 2-inch by 2-inch square steel tubing. In this particular instance, diamond mesh 160 is shown welded to an exterior side of the floor frame. Other possible floor shapes include triangular, rectangular, hexagonal, octagonal, etc. Also depicted, by way of example, is the space on the floor 200 above which a 24-inch by 72-inch locking, hinged, 4-hour, fire-rated door 300 might be hung. Referring to FIGS. 15A, 15B, the door 300 comprises a vertical, exterior, steel plate 300P reinforced at its interior, bottom margin by lateral, square steel tubing 300S to which is attached steel angle 300A. Similar steel angle 300A and square steel tubing (not shown) reinforce the interior, top margins of the door 300.

A blast- and ballistic-resistant glass observation port 150 is preferably standard and located near the top of each panel; FIG. 4A. If all the side panels of an assembled shelter include the glass observation ports 150, as will generally be the case, the ports permit almost 360° visual monitoring and surveillance of the area around the shelter, such as by optical, infrared, motion sensor and other instrumentation and detectors. Referring to FIG. 4B, the glass 151 is secured in place by upper and lower steel channels 152 disposed between, and welded to, upper end portions of the left and right beams 30, 32. Also included in each panel are reinforcing gusset plates 260 at each interior angle formed between structural members of the panel frame; FIGS. 7A, 10A, 13D. Typically, the gusset plates 260 comprise half-inch thick steel plate.

Figure 13A:
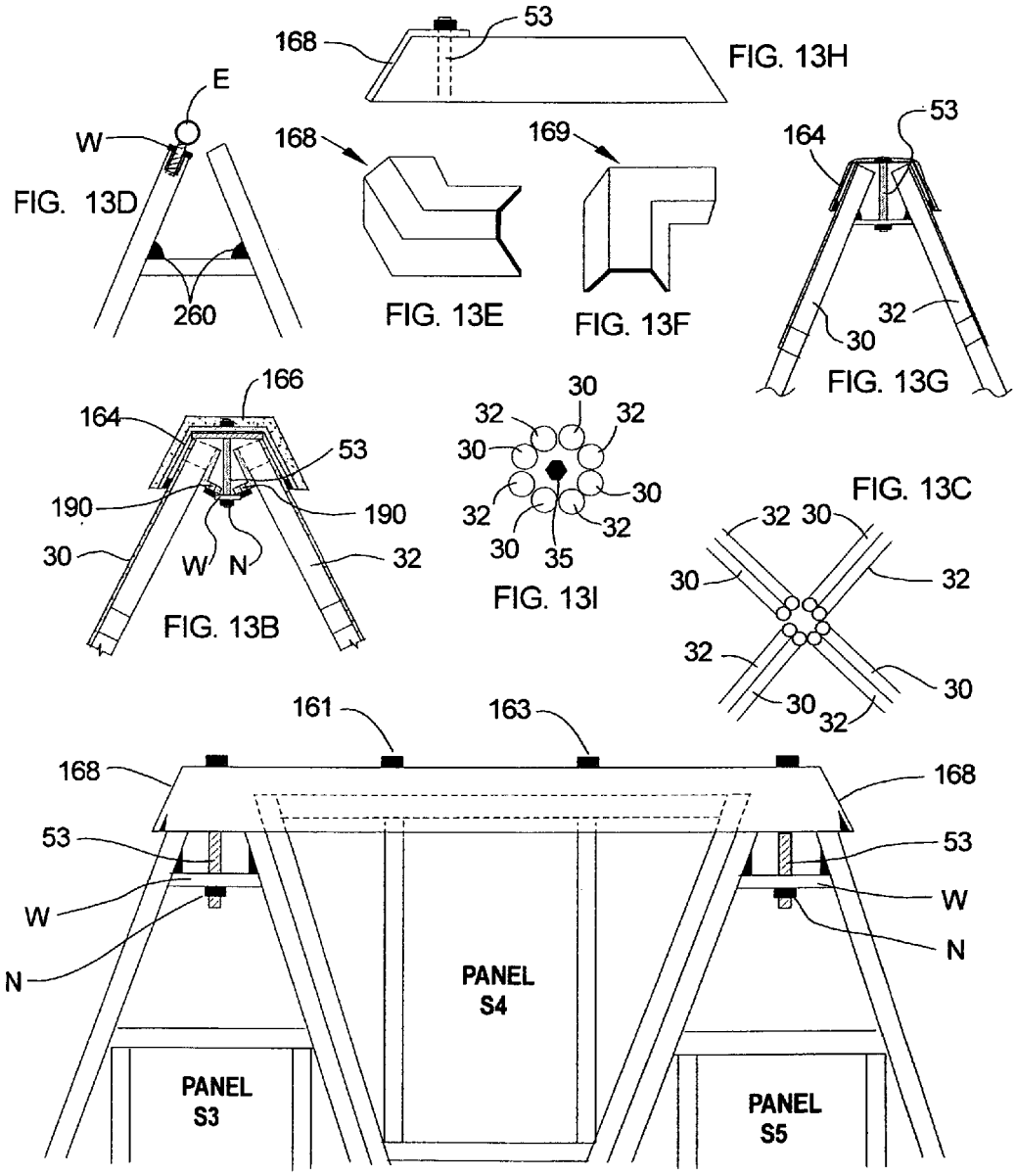
FIG. 13A is an enlarged, fragmentary, elevational view of the apex-ridge portion of the second embodiment of the invention depicted in FIGS. 2 and 3B.

In FIG. 2, the base beam 34 of the inverted panel B defines a roof ridge for the second embodiment 100 of the invention and extends between left and right apexes 20, 20. Construction details of these apexes 20, 20 and of the roof ridge are depicted in FIGS. 13A-13H. To facilitate lifting each panel into a desired position on-site during construction of a shelter 10, 100, a washer W with an attached, extended nut N is inserted inside and welded to an open end of one of the beams 30, 32 at the apex 20 of a panel and an eyebolt E is temporarily threaded into the nut; FIG. 13D. A crane or other lifting device can engage the eyebolt to lift and move a non-inverted panel as needed on-site, and the eyebolt E is afterwards removed.

For lifting and moving an inverted panel, such as panel S4 of FIGS. 2 and 13A, a different procedure is required. At each of two apex-ridge locations 161 and 163 (FIG. 13A), an apertured, apex-ridge, 0.25-inch steel plate 164 is attached to an underside of the apex-ridge, as depicted in FIG. 13B. An apertured, steel angle 190 with a tack-welded nut N is attached to each of the inner, apposed, surfaces of the beams 30, 32 just below the apex 20; FIGS. 13B, 14A. During on-site construction, an eyebolt E (not shown) is threaded into the washer W-nut N combination to provide a point of attachment for lifting and moving the inverted panel, which eyebolt is afterwards removed. A mating, permanent, through bolt 53 attaches the apex-ridge, steel plate 164 to cover that apex-ridge location 161, 163. This permanent bolt 53 extends down through an aperture in the steel plate 164 and is threaded into a nut N that is tack welded to a washer W, such that tightening the bolt forces said washer W into engagement with the web portions of the steel angles 190.

A suitable coating 166 is afterwards placed over the ridge cap 164, depending on the particular application for which the shelter 100 is intended; see FIG. 13G. A steel, apex-ridge corner cap 168 is provided as depicted in FIG. 13E for covering a corner end of the roof ridge as shown in FIG. 13B and secured thereto by a bolt 53. For adding a perpendicular extension on to a shelter 100, a 90° apex-ridge end cap 169 is also provided and attachable by a bolt 53 to a corner end of the roof ridge; FIG. 13F. A similar plan view of the upper ends of the eight beams of four joined panels of a square pyramid shelter 10 is shown in FIG. 13C (the shaded beams include washers for receiving eyebolts). As may be seen in FIG. 14A, seals S are inserted between the exterior steel plate 174 of the side panels and the apex-ridge steel plate 164.

FIGS. 10C, 10E, 15A, 15B depict a 24-inch wide by 72-inch high, 4-hour fire-resistant, outward-swinging, steel door 300 mounted by heavy-duty, steel hinges 302 to square tubular door jambs 38, 40 of a side panel, which allows ingress and ingress inside a pyramidal shelter 10, 100. Valuables such as irreplaceable family heirlooms, documents, and jewelry can be placed in water tight containers and placed inside this structure for protection. Typically, this shelter 10 will be shaped as a four-sided, square pyramid because a square pyramid shelter will be able to store more valuables than a triangular pyramid comprised of side panels of the same size. A heavy-duty door lock 304 is provided, which is easily camouflaged to deter tampering or unauthorized entry.

Among the applications for the shelter 10, 100 of the present invention are the following:

Protection of above-ground valves, such as oil and liquefied natural gas valves, which are critical infrastructures that need to be protected from terrorists. The blast-resistant structures the invention provides are ideally suited since they can be easily assembled on-site and anchored to the ground in just about any soil conditions. Soft soil conditions such as sand will require longer rebar stakes while very dense soil conditions will require shorter rebar stakes. The angled design of the driven rebar stakes provides excellent resistance to lateral and vertical forces that arise during a high pressure blast event. In addition, the blast-resistant structure can be camouflaged, for example, with mineral rock that can make it look like part of the surroundings and can reduce the likelihood of detection and possible attack.

Oil well head protection is provided because a shelter 100 can cover and enclose the entire oil well head assembly and thereby protect an oil well head from improvised explosive devices (IEDs), home-made bombs, ballistic and shaped charge threats, and aerial attacks. The optional protective floor of the shelters 10, 100 prevents an attacker from burrowing underneath and entering the shelter to set off a charge.

Border security and patrol is another important application for the present invention. As FIG. 1 shows, blast-resistant glass in side panel ports near the top of each shelter 10 can provide nearly a 360° view of the border areas. The effective line-of-sight distance is only limited by any obstructions that may be in the way, which can be minimized by the field placement of these shelters, used as automated, border sentinels. An infrared device installed in these blast-resistant structures has the capability to detect any moving object such as individuals or vehicles, day or night, by their heat signatures as well as their heading and their speed. This information can be automatically relayed to a centralized border patrol station where border patrol can pinpoint their location and their direction and make the necessary arrests. The U.S. has nearly a 2,000 mile border with Mexico and over a 3,000 mile border with Canada, both of which can be relatively easily monitored using the present invention. The same features and advantages of the present invention can be usefully applied as well to perimeter and area surveillance generally.

Coastal surveillance can be improved by placing the shelters 10, 100 both above ground in coastal regions as well as under water in marine inlets, bays, coves and the like. For use under water, the shelters 10, 100 need only be made water tight. Equipped with sonar or similar state-of-the-art underwater detection apparatus, they can be used to help detect and identify under- and over-the-water movements, such as drug smuggling vessels or drug-carrying miniature submarines and automatically provide detection data to a central command system that would be able to respond promptly using interdiction protocol. More generally, the shelters 10, 100 of the present invention can be designed to be resistant to an electromagnetic impulse (EMI), thermal shock wave, be radiation hardened, and protect against intense sound waves. Equipped with infrared, sonar and/or radar detectors they can provide early detection and warning of unidentified individuals, vehicles, flying aircraft and other flying objects as well as submarines where national security requires those capabilities. This extra level of protection can be provided by the judicious choice of composite, armored layers securely attached to the sheet metal plates 174.

Safe room protection can be achieved against some of the threats listed above. In a worst case scenario, instead of having to climb down into an underground bunker, a well-designed, above-ground shelter according to the present invention can provide some level of protection for individuals from nuclear, chemical and biological attacks. This invention, since it is modular and expandable to just about any size or shape, can be made so that it can accommodate a predetermined number of individuals—family members, for example—for a limited length of time. Reiterating, some of the advantages of this invention are modularity, expandability, positive anchorage to the ground without the need for concrete, choice of composite armor paneling depending upon the level of threat, natural or man-made, and the relative ease of assembly. With the ability to camouflage this above-ground safe room with mineral rock, or equivalent, it can blend aesthetically with the natural surroundings or can actually be built into the residential, commercial, industrial, or military structure itself without being noticed from the outside.

The shelters 10, 100, 200 can be a defensive or offensive platform due to the surveillance ports at the top of these structures. Not only can the optical, infrared, and motion sensors detect objects, including air, sea, and ground vehicles, but they could potentially detect signals such as cellular telephone traffic with the right kind of detection equipment.

Thus, it should be evident that a modular system for on-site assembly of a shelter has been shown and described in sufficient detail to enable one of ordinary skill in the art to practice the invention. Since various modifications in detail, materials, arrangements of parts, and equivalents thereof, are within the spirit of the invention herein disclosed and described, the scope of the invention should be limited solely by the scope of the appended patent claims.

We claim:

1. A modular system for on-site assembly of a shelter and attachment of the shelter to a ground surface, comprising:

three or more factory-preassembled, triangular side panels, each of said triangular side panels being of equal size and including a triangular, panel frame, said triangular, panel frame comprising a rigid first side beam, a rigid second side beam, and a rigid base beam, the first and second side beams having upper ends joined at an apex of said triangular, panel frame and the base beam extending between, and joined to, opposite, lower end portions of the first and second side beams;

coupling means attached to the first and second side beams for attaching in mating engagement parallel, side by side alignment a first side beam of said triangular, panel frame to a second side beam of a triangular, panel frame of any other triangular side panel of said system; and covering means partially or fully covering at least one side of said triangular panel frame;

anchor means reversibly attachable to a lower end portion of each of said triangular side panels for securing a triangular side panel to the ground at a location selected for on-site assembly of the shelter, said anchor means including a corner anchor assembly for each corner of said shelter after said shelter has been assembled, said corner anchor assembly including a lower anchor plate having an upper surface and an opposite, lower surface;

a split, upper anchor plate comprising a first upper plate and a second upper plate in coplanar, side by side relation;

wherein the lower anchor plate and the first upper plate and the second upper plate each have a plurality of rebar apertures disposed and dimensioned for insertion of rebar therethrough;

fastener means for reversibly attaching the first and/or second upper plates to an upper surface of the lower anchor plate; and telescopically adjustable means attached to, and extending upward and away from, the first upper plate and/or the second upper plate for reversibly attaching either one or both of the first and second upper plates to a lower end of a first or second side beam; and wherein, once said modular system has been assembled at said location to form a shelter and has been attached to said ground surface by rebar driven into the ground through said rebar apertures of each corner anchor assembly, and the first and second upper anchor plates of each corner anchor assembly overlie, rest upon, and are attached by said fastener means to the lower anchor plate of said each corner anchor assembly and are attached by the telescopically adjustable means to a lower end of a first or second side beam, either of the first or second upper anchor plates of each corner anchor assembly can be detached from the lower anchor plate thereof to facilitate removal of a side panel from the shelter and attachment of additional side panels to the shelter and thereby expand the size of the shelter.

2. The modular system of claim 1, wherein each of the first and second side beams has a hollow, lower end portion and each of the first and second upper plates includes an upstanding anchor rod, said upstanding anchor rod having a lower end attached to said upper plate at a 60 degree angle with respect to said upper plate and an opposite, upper end, said opposite, upper end being dimensioned for insertion into the hollow, lower end portion of a first or second side beam, and means for reversibly locking the upstanding anchor rod within said hollow, lower end portion.

3. The modular system of claim 1, further including sealing means for sealing gaps and interfaces between side triangular panels once the triangular side panels have been assembled on-site to form a shelter.

4. The modular system of claim 1, wherein the base beam of one or more of the triangular side panels comprises steel square tubing reinforced by steel angle.

5. The modular system of claim 2, wherein, for each triangular side panel, the coupling means includes steel strapping having a plurality of spaced-apart apertures;

said steel strapping is attached to and extends lengthwise along said first and second side beams at a first and at a second, opposite edge of each of said triangular side panels; and said steel strapping is oriented with respect to an interior surface of said panel of said triangular side panels either 90 degrees interiorly, 45 degrees proximally, 135 degrees distally, or 30 degrees proximally.

6. The modular system of claim 2, wherein at least one of the three or more triangular side panels includes a rectangular door frame, and said door frame comprises a header disposed at an upper end of said door or hatch access frame, which header extends between, and is attached to, upper portions of the first and second side beams of said triangular side panel; and parallel left and right jambs that are attached to left and right end portions of the header and extend therefrom to the base beam of said triangular side panel, each of said left and right jambs having a hollow, lower end portion; and the anchor means further includes for each of the left and right jambs, a mid-base beam anchor assembly, comprising a mid-base anchor plate having one or more rebar apertures;

an upstanding anchor rod, said upstanding anchor rod having a lower end attached to the mid-base anchor plate at a 60 degree angle with respect to said mid-base anchor plate and an opposite, upper end, said opposite, upper end being shaped and dimensioned for telescopic insertion into the hollow, lower end portion of either the left or the right jamb, and means for reversibly locking said anchor rod within said lower end portion.

7. The modular system of claim 5, wherein the modular system includes at least four equilateral, triangular side panels that can be assembled on-site to form a square pyramid shelter, said square pyramid shelter having a square base, and said steel strapping is oriented 90 degrees interiorly with respect to each of said four, equilateral, triangular side panels.

8. The modular system of claim 7, further including a square floor frame, said square floor frame being attachable to the base beams of said four triangular side panels in congruent, covering relation to said square base of said square pyramid shelter, and said square floor frame comprises an orthogonal grid formed by longitudinally spaced-apart, lateral struts intersecting and attached to laterally spaced-apart, longitudinal struts.

9. The modular system of claim 8, wherein the base beams of said four equilateral, triangular side panels and the lateral and longitudinal struts of the orthogonal grid of said floor frame comprise square steel tubing.

* * * * *